US009177538B2

(12) United States Patent
Dreher

(10) Patent No.: US 9,177,538 B2
(45) **Date of Patent: *Nov. 3, 2015**

(54) CHANNEL-MAPPED MIDI LEARN MODE

(71) Applicant: MixerMuse, LLP, Louisville, CO (US)

(72) Inventor: Mark Randall Dreher, Louisville, CO (US)

(73) Assignee: MIXERMUSE, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/072,330

(22) Filed: Nov. 5, 2013

(65) Prior Publication Data

US 2014/0053712 A1 Feb. 27, 2014

Related U.S. Application Data

(63) Continuation-in-part of application No. 13/270,091, filed on Oct. 10, 2011, now Pat. No. 8,604,329.

(51) Int. Cl.
*G10H 1/00* (2006.01)
*G10H 1/46* (2006.01)

(52) U.S. Cl.
CPC ..... *G10H 1/0066* (2013.01); *G10H 1/0033* (2013.01); *G10H 1/46* (2013.01); *G10H 2220/106* (2013.01); *G10H 2240/011* (2013.01); *G10H 2240/056* (2013.01); *G10H 2240/311* (2013.01)

(58) Field of Classification Search
USPC ..... 84/645
IPC ..... G10H 1/0066,2240/011, 2240/056, G10H 2240/311
See application file for complete search history.

(56) References Cited

U.S. PATENT DOCUMENTS

| | | | | |
|---|---|---|---|---|
| 5,083,491 | A * | 1/1992 | Fields | 84/21 |
| 6,103,964 | A * | 8/2000 | Kay | 84/611 |
| 6,160,213 | A * | 12/2000 | Arnold et al. | 84/615 |
| 7,545,936 | B2 * | 6/2009 | Terada et al. | 380/203 |
| 7,915,514 | B1 * | 3/2011 | Shrem et al. | 84/645 |
| 8,404,958 | B2 * | 3/2013 | Shrem et al. | 84/645 |
| 8,604,329 | B2 * | 12/2013 | Dreher | 84/645 |
| 2001/0046298 | A1 * | 11/2001 | Terada et al. | 380/252 |
| 2002/0170415 | A1 * | 11/2002 | Hruska et al. | 84/609 |
| 2004/0267541 | A1 * | 12/2004 | Hamalainen et al. | 704/278 |

(Continued)

OTHER PUBLICATIONS

P. Prusinkiewicz and C. Knelsen, Virtual Control Panels, Proceedings of Graphics Interface '88, pp. 185-191.

*Primary Examiner* — David Warren
(74) *Attorney, Agent, or Firm* — Marsh Fischmann & Breyfogle LLP; Daniel J. Sherwinter

(57) ABSTRACT

Embodiments of the invention include systems and methods for inferential generation of virtual sequencer controls in a MIDI sequencer to automate functionality of physical or virtual controls of MIDI instruments. MIDI source data from a song or a live feed is analyzed to determine a sequence of MIDI control commands from which a set of virtual sequencer controls can be automatically inferred without manual generation or configuration of the virtual control. The virtual sequencer controls are generated to automate a corresponding MIDI instrument control. Some embodiments provide functionality, including generation and handling of clone controls, use of virtual sequencer controls as slave and/or translation controls, and handling of after-click control information through a virtual synthesizers and the like.

20 Claims, 12 Drawing Sheets

(56) References Cited

U.S. PATENT DOCUMENTS

| | | | | |
|---|---|---|---|---|
| 2005/0165814 | A1* | 7/2005 | Taruguchi | 707/100 |
| 2005/0166067 | A1* | 7/2005 | Taruguchi | 713/193 |
| 2005/0210276 | A1* | 9/2005 | Taruguchi | 713/193 |
| 2005/0211076 | A1* | 9/2005 | Park et al. | 84/645 |
| 2007/0039449 | A1* | 2/2007 | Redmann | 84/609 |
| 2009/0092244 | A1* | 4/2009 | Terada et al. | 380/28 |
| 2009/0205481 | A1* | 8/2009 | Kulkarni et al. | 84/609 |
| 2010/0132536 | A1* | 6/2010 | O'Dwyer | 84/609 |
| 2010/0179674 | A1 | 7/2010 | Willard et al. | |
| 2010/0180224 | A1* | 7/2010 | Willard et al. | 715/773 |
| 2011/0146479 | A1* | 6/2011 | Shrem et al. | 84/645 |
| 2012/0014673 | A1* | 1/2012 | O'Dwyer | 386/282 |
| 2013/0087037 | A1* | 4/2013 | Dreher | 84/645 |
| 2013/0160633 | A1* | 6/2013 | Shrem et al. | 84/622 |
| 2013/0233154 | A1* | 9/2013 | Little et al. | 84/609 |
| 2014/0053712 | A1* | 2/2014 | Dreher | 84/645 |

* cited by examiner

1100

CHANNEL-MAPPED MIDI LEARN MODE

BACKGROUND

Embodiments relate generally to musical instrument digital interface (MIDI) controls, and, more particularly, to inferential generation of virtual MIDI controls.

Home and professional music recording and performance studios include various types of gear for controlling audio and related data. Digital audio equipment is often configured to communicate via MIDI commands, which includes both note data and control data. The control data indicates the state (e.g., value) of physical and/or virtual MIDI instrument controls, like pan, fader, channel pressure, etc. It is desirable to use at least one MIDI instrument (e.g., a keyboard, sequencer, etc.) to control at least one other MIDI instrument using MIDI commands. However, the ability to truly automate a MIDI instrument's controls is typically very limited.

Some very high-end MIDI instruments (e.g., for professional studios) have motorized controls that are configured for remote automation. However, this type of motorization is expensive and not available on the bulk of consumer gear. Some other MIDI merits have dedicated software that includes preconfigured virtual controls for automating controls of the MIDI instrument using MIDI commands through MIDI ports (e.g., as plug-ins for software sequencers). However, this type of dedicated software tends to be very limited in which controls are automated and in which ways, and the software is limited only to the associated MIDI instrument. Accordingly, even limited automation of multiple MIDI instruments would involve multiple pieces of software that may not be able to be integrated.

Various commercial software products further allow users to instantiate and modify "canned" MIDI controls. For example, if a user purchases a new MIDI instrument that has 16 different MIDI controls and no dedicated software automation package, the user may be able to manually model each control. For each control, the user would instantiate a canned MIDI control (e.g., a slider or knob) and would use knowledge of the control functionality and the MIDI specification to assign all its various parameters. While this type of automation can certainly be powerful, it is typically cumbersome and error-prone, and may involve advanced knowledge of the MIDI specification.

BRIEF SUMMARY

Among other things, systems and methods are described for inferential generation of virtual sequencer controls in a MIDI sequencer to automate functionality of physical or virtual controls of MIDI instruments in context of extended MIDI commands, such as bank switching commands. MIDI source data from a song or a live feed is analyzed to determine a sequence of MIDI control commands from which a set of virtual sequencer controls can be automatically inferred without manual generation or configuration of the virtual control. For example, the MIDI source data includes various bank switch command that apply to some or all of a number of MIDI instrument controls. The bank switch commands can be buffered and applied to appropriate MIDI instrument control data over appropriate time windows so that virtual controls can be generated (e.g., inferred and/or used in a manner that properly accounts for the bank switching. Embodiments include channel mapping functions that facilitate proper application of the extended MIDI commands even when received on channels other than those used for receipt of the associated instrument control data. Some implementations further include novel schemes for mitigating exchange of redundant or otherwise unnecessary data corresponding to such extended MIDI commands.

According to one set of embodiments, a method is provided for inferentially generating a virtual sequencer control from a sequence of MIDI commands. The method includes: receiving the sequence of MIDI commands generated by a number of MIDI instrument controls of at least one MIDI instrument; identifying a set of control data from the sequence of MIDI commands as sharing an identified MIDI port, an identified MIDI channel, and an identified MIDI control change; identifying an extended MIDI control command from the sequence of MIDI commands that extends functionality of the identified MIDI control change; and generating a proposed virtual sequencer control within a virtual MIDI sequencer, such that the proposed virtual sequencer control is configured to generate control commands corresponding to the identified MIDI control change and to output the control commands over the identified MIDI port and the identified MIDI channel in accordance with the extended functionality of the extended MIDI control command.

According to another set of embodiments, computer-implemented sequencer system is provided that is configured to communicate with a number of MIDI instrument controls of at least one MIDI instrument via a number of MIDI channels over at least one MIDI port. The sequencer system includes: a number of virtual sequencer control modules, each configured to generate and output control commands for automating at least one of the MIDI instrument controls; a graphical user interface (GUI) module configured to provide manipulation of the control commands associated with each virtual sequencer control via virtual manipulation by a user of an interactive GUI element corresponding to that virtual sequencer control; and an inferential control generator. The inferential control generator is configured to: identify a set of control data from a received sequence of MIDI commands as sharing an identified MIDI port, an identified MIDI channel, and an identified MIDI control change, all associated with a particular MIDI instrument control; identify an extended MIDI control command from the sequence of MIDI commands that extends functionality of the identified MIDI control change; and generate a proposed virtual sequencer control configured to generate control commands corresponding to the identified MIDI control change and to output the control commands over the identified MIDI port and the identified MIDI channel in accordance with the extended functionality of the extended MIDI control command.

BRIEF DESCRIPTION OF THE DRAWINGS

The present disclosure is described in conjunction with the appended figures.

Figure 1:
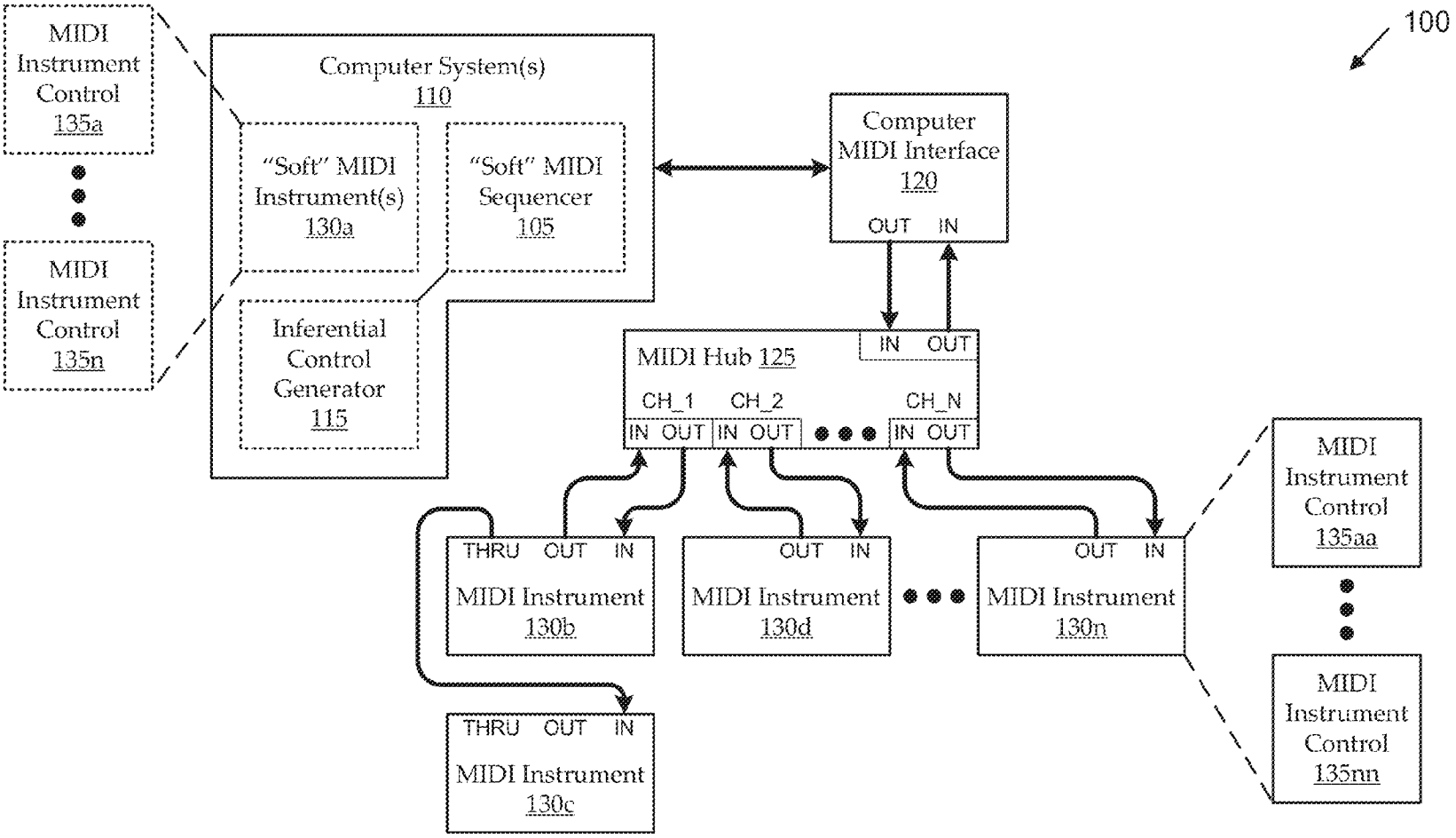
FIG. 1 shows a simplified block diagram of an illustrative studio environment for use with various embodiments.

In the appended figures, similar components and/or features may have the same reference label. Further, various components of the same type may be distinguished by following the reference label by a second label that distinguishes among the similar components, if only the first reference label is used in the specification, the description is applicable to any one of the similar components having the same first reference label irrespective of the second reference label.

DETAILED DESCRIPTION

In the following description, numerous specific details are set forth to provide a thorough understanding of the present invention. However, one having ordinary skill in the art should recognize that the invention may be practiced without these specific details. In some instances, circuits, structures, and techniques have not been shown in detail to avoid obscuring the present invention.

It is common for studios to have a number of instruments with varying types of functionality. For example, even a small studio may have a keyboard, effects module, guitar controller, sequencer, and digital recorder. Further, each instrument may have a number of controls. For example, each instrument may have controls for volume, pan, fader, pitch bend, aftertouch, etc. Accordingly, studio data may be controllable via hundreds of controls.

Some or all of the instruments may include MIDI support, such that their controls can generate and/or be affected by MIDI commands. It is highly desirable to use those MIDI capabilities to automate as many of the MIDI instrument control functions as possible. For example, many modern studios use software products to perform various sequencer capabilities. Some of these so-called "soft" sequencers (e.g., or, alternatively, implemented as functionality of other types of soft instruments, including soft samplers, soft synthesizes, etc.) can receive and generate MIDI data, which can be used to run some or all of the equipment in the studio. However, automation of many (or even air) of the large numbers of controls in the studio may require manual creation and configuration of virtual controls within the "soft" sequencer, which can be cumbersome and error-prone, and may involve advanced knowledge of the MIDI specification.

Embodiments include an inferential control generator that can generate inferred virtual MIDI sequencer controls from MIDI source data. MIDI source data from a song or a live feed is analyzed to determine a set of MIDI control commands. The control commands are analyzed to automatically infer a set of virtual MIDI sequencer controls to correspond to at least a portion of the MIDI source data. The virtual MIDI sequencer controls are generated in such a way that they are automatically associated with a corresponding physical or virtual MIDI instrument control. Accordingly, the virtual MIDI sequencer controls can be used to automate the functionality of the corresponding MIDI instrument control without manual creation or modification of the control, even when there is do dedicated software and/or hardware automation package for the MIDI instrument.

Once the virtual MIDI sequencer controls are generated, they can be used to provide various types of functionality. Some embodiments can group virtual MIDI sequencer controls into virtual MIDI sequencer instruments, and can further group virtual MIDI sequencer instruments into virtual MIDI sequencer stacks. The stack can effectively act as an integrated, automated, "soft" version of the studio. Some embodiments can also synchronized the virtual studio (e.g., some or all of the component virtual MIDI sequencer controls) with other software or hardware products packages, for example, via a MIDI Time Clock (SMPTE), beat clock, or the like. Various other embodiments provide functionality, including generation and handling of clone controls, use of virtual MIDI sequencer controls as slave and/or translation controls, and handling of after-click control information through a virtual keyboard.

Turning first to FIG. 1, a simplified block diagram is shown of an illustrative studio environment 100 for use with various embodiments. The studio environment 100 is controlled by a computer system 110 (e.g., which may be implemented as multiple computer systems) in communication with a computer MIDI interface 120. The computer MIDI interface 120 can be implemented in any useful way, including as an external MIDI interface module coupled with the computer system 110 via a standard digital interface (e.g., USB, Firewire, optical, etc.), a MIDI interface card coupled with the computer via a bus, etc.

The computer MIDI interface 120 is either coupled with, integrated into, or otherwise in communication with a MIDI hub 125. As illustrated, the MIDI hub 125 includes a number of MIDI in and out ports, some or all of which being coupled with MIDI instruments 130. In some embodiments the MIDI hub 125 is configured so that each pair of MIDI ports is assigned to a particular MIDI channel (e.g., channel 1-16). In configurations where the computer MIDI interface 120 is separate from the MIDI hub 125, a pair of MIDI ports may be provided for that connection. Typically, for a given pair of MIDI ports, the MIDI out port is coupled with a MIDI in port of a MIDI instrument, and the MIDI in port is coupled with a MIDI out port of the MIDI instrument. Some MIDI hubs 125 include additional ports, such as additional MIDI out ports without corresponding in ports.

The studio environment 100 can include any number and type of MIDI instrument 130. Some types of MIDI instruments 130 include keyboard controllers, guitar controllers, wind controllers, sequencers, samplers, sound modules, effects modules, lighting controllers, video controllers, etc. Further, some MIDI instruments 130 are physical instruments (e.g., a physical piano keyboard), while others are virtual "soft" instruments (e.g., a virtual keyboard implemented in software). In fact, most modern MIDI instruments 130 could be considered hybrid instruments in that they are physical components with the majority of their functionality being implemented in software.

For the purposes of this disclosure, discussions of MIDI instruments 130 are intended generally to include any type of MIDI instrument, whether physical, virtual, or any combination thereof. Further, the MIDI specification has expanded over time to include functionality relating, not only to music, but also to lighting, video, and other types of controls. Accordingly, music-centric terminology is intended only to be illustrative and should not limit the application of embodiments to other environments. For example, a "note on" event may alternatively be a "light on" event, or the like. Similarly, references to "MIDI," the "MIDI specification," or the like is intended to include any past, current, or future versions of MIDI and MIDI-related specifications (i.e., not only the MIDI 1.0 specification).

MIDI instruments 130 can be connected in various ways, and can communicate in various ways, accordingly. "Soft" MIDI instruments (e.g., MIDI instrument 1300 use various software and/or hardware techniques to simulate one or more MIDI in and Gut channels. For example, a MIDI sequencer can communicate with a "soft" MIDI instrument 130*a* by assigning one or more physical or virtual channels or ports through which to send and/or receive MIDI commands. Other MIDI instruments (e.g., MIDI instrument 130*b*-130*n*) typically use standard hardware ports to send and/or receive MIDI commands. These hardware ports can be connected to other hardware ports using standard cables (e.g., standard MIDI cables) or other techniques.

As discussed above, a MIDI instrument 130 may include at least one MIDI in, MIDI out, and/or MIDI thru port. Commands generated by a first MIDI instrument 130 can be sent out to a second MIDI instrument 130 through its MIDI out port, and MIDI commands generated by the second MIDI instrument 130 can be received by the first MIDI instrument 130 through its MIDI in port. The MIDI thru port can be used by the first MIDI instrument 130 to receive MIDI commands generated by the second MIDI instrument 130 and send them without alteration to a third MIDI instrument 130.

For the sake of illustration, MIDI instrument 130*b* is in two-way communication with the MIDI hub 125 via MIDI in and out ports. In particular, the MIDI in port of the MIDI instrument 130*b* receives MIDI information over MIDI channel "1" from the MIDI out port of the MIDI hub 125, and the MIDI out port of the MIDI instrument 130*b* transmits MIDI information generated by the MIDI instrument 130*b* over MIDI channel "1" to the MIDI in port of the MIDI hub 125. Further, the MIDI instrument 130*b* is in communication with MIDI instrument 130*c*. In particular, the MIDI thru port of the MIDI instrument 130*b* is coupled with the MIDI in port of the MIDI instrument 130*c*. In this way, the MIDI commands received over MIDI channel "1" from the MIDI out port of the MIDI hub 125 are also passed through MIDI instrument 1301) to MIDI instrument 130*c* without alteration by MIDI instrument 130*b* (i.e., those MIDI commands can be used to control both MIDI instruments 130 concurrently).

Each MIDI instrument 130 can be thought of as a set of MIDI instrument controls 135. Indeed, the MIDI command traffic traversing the various physical and virtual MIDI links in the studio environment 100 is essentially a stream of MIDI commands being generated by physical and virtual MIDI controls. The various MIDI commands can then be interpreted according to data, including port and/or channel identification, control change data, bank change data, note data, and control value data.

Much of the functionality of embodiments described herein relate to handling of the MIDI command traffic. As illustrated, the studio environment 100 includes a MIDI sequencer 105, which may be implemented as a software product (i.e., a "soft" MIDI sequencer) in the computer system 110. In alternative embodiments, the MIDI sequencer 105 is integrated in a MIDI instrument 130 that is external to the computer system 110 or is implemented in any other useful way. As will be discussed more fully below, embodiments of the MIDI sequencer 105 include or are in communication with an inferential control generator 115. While referred to herein as a MIDI sequencer 105 for the sake of clarity, it will be appreciated that this term is intended broadly to include any physical and/or virtual system or component for handling MIDI commands.

A studio environment 100 can be configured in many different ways to perform many different types of functions using different numbers and types of MIDI ports. However, many of the functions described herein, including inferential control generation, assume that a particular MIDI instrument 130 has both MIDI in and MIDI out support. Accordingly, the various MIDI instrument controls 135 described with reference to embodiments are assumed to support both MIDI in and MIDI out and not to already be automated.

For the sake of clarity, the following terminology will be used herein to describe embodiments. A MIDI instrument control 135 is any physical or virtual control element that generates MIDI control commands. Some MIDI instrument controls 135 are also controllable by received MIDI control commands. A MIDI instrument 130 is finite (and typically related) set of MIDI instrument controls 135. For example, a synthesizer, lighting controller, sampler, sequencer, sound module, or other instrument can be implemented as a MIDI instrument 130 by making some or all of its functionality controllable using MIDI instrument controls 135. A group of MIDI instruments 130 is referred to herein as a "stack." For example, a goal for studio automation may be to configure the MIDI sequencer 105 to automate as much of the stack as possible. Embodiments of the MIDI sequencer 105 include "virtual sequencer controls." As discussed below, the virtual sequencer controls include both "manually generated" virtual sequencer controls (e.g., created manually by a user through an interface of the MIDI sequencer 105 package) and "inferred" virtual sequencer controls (e.g., created automatically by the inferential control generator 115). As used herein, a virtual sequencer control includes any type of virtual MIDI control configured to automate a respective MIDI instrument control 135 of a MIDI instrument 130. For example, the MIDI sequencer 105 may include a virtual fader control, such that interaction with the fader control generates MIDI commands to automate functionality of a physical fader control on a synthesizer in the studio. Notably, while the virtual sequencer controls are generally discussed as existing within the MIDI sequencer 105, embodiments may be implemented in other contexts.

Figure 2:
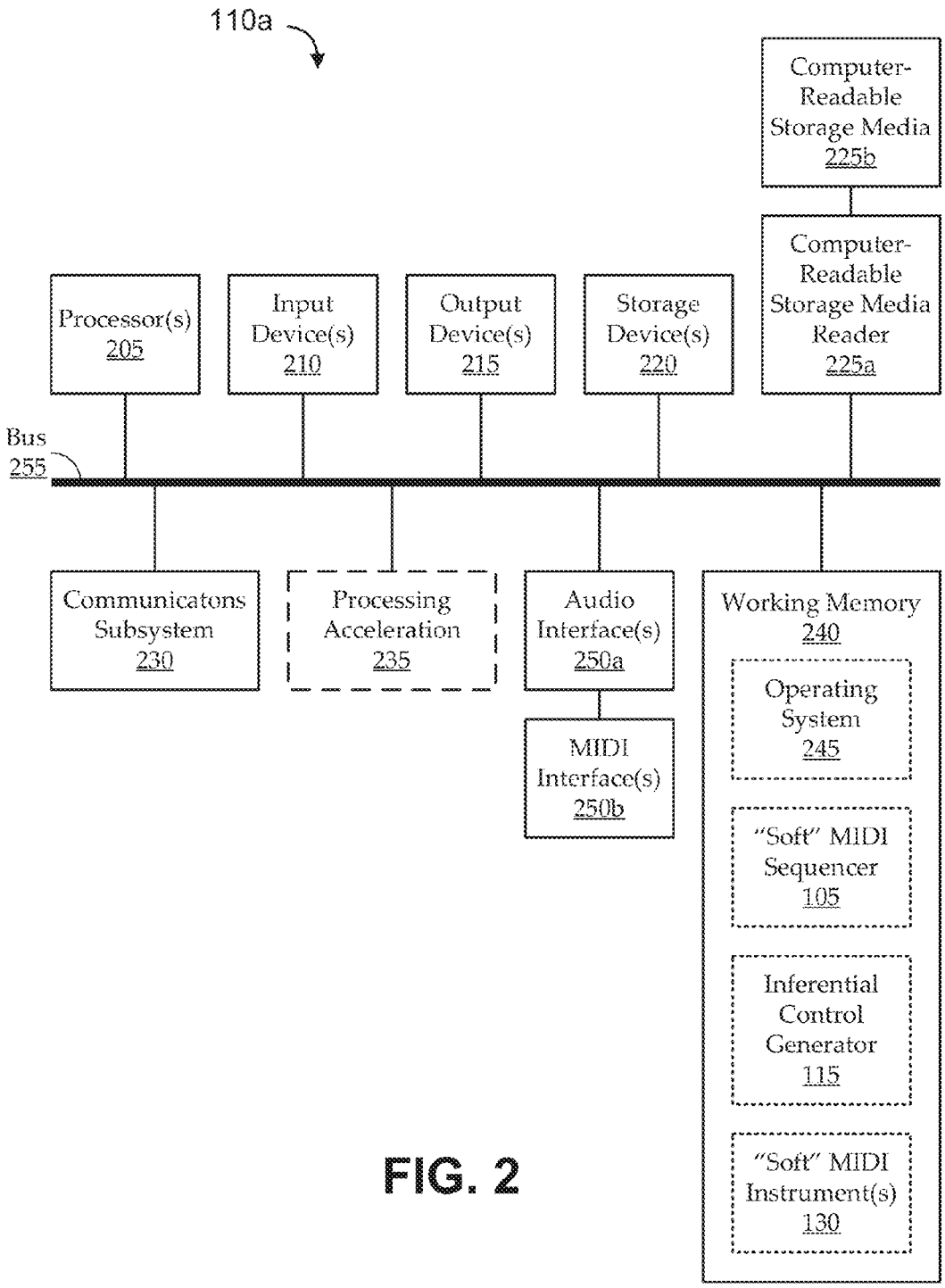
FIG. 2 shows an exemplary computer system for implementing various embodiments.

FIG. 2 shows an exemplary computer system 110*a* for implementing various embodiments. The computer system 110*a* may be implemented as or embodied in single or distributed computer systems, or in any other useful way. For the sake of illustration, the computer system 110*a* is shown including hardware elements that may be electrically coupled via a bus 255.

The hardware elements may include one or more processors (e.g., central processing units (CPUs)) 205, one or more input devices 210 (e.g., a mouse, a keyboard, etc.), and one or more output devices 215 (e.g., a display device, a printer, speakers, an audio recorder, etc.). The computer system 110*a* may also include one or more storage devices 220. By way of example, storage device(s) 220 may be disk drives, optical storage devices, solid-state storage devices such as a random access memory (RAM) and/or a read-only memory (ROM), which can be programmable, flash-updateable, and/or the like.

The computer system 110*a* may additionally include a computer-readable storage media reader 225*a*, a communications subsystem 230 (e.g., a modem, a network card (wireless or wired), an infra-red communication device, etc.), and working memory 240, which may include RAM and ROM devices as described above. The computer-readable storage media reader 225*a* can further be connected to a computer-readable storage medium 225*b*, together (and, optionally, in combination with storage device(s) 220) comprehensively representing remote, local, fixed, and/or removable storage devices plus storage media for temporarily and/or more permanently containing computer-readable information. The communications subsystem 230 may permit data to be exchanged with a network and/or any other computer as described above with respect to the computer system 110*a*.

In some embodiments, the computer system 110*a* may also include a processing acceleration unit 235, which can include a DSP (e.g., a dedicated audio processing card), a special-purpose processor and/or the like. Further the computer system 110*a* may include one or more audio interfaces 250*a* and/or MIDI interfaces 250*b* (e.g., implemented as one or more dedicated interface cards, or the like). For example, a MIDI interface card may be installed in the computer system 110*a* and may include analog audio ports, digital audio ports, MIDI ports, optical ports, and/or other types of ports. Alternately, hardware or software support may be provided to facilitate use of a universal serial bus (USB) or similar type of port to be used as an audio interface 250*a* and/or a MIDI interface 250*b*.

The computer system 110*a* may also include software elements, shown as being currently located within a working memory 240, including an operating system 245 and/or other code, such as an application program (which may be a client application, web browser, mid-tier application, RDBMS, etc.). For example, as described with reference to FIG. 1, various automation and/or other functions of studio environment 100 may be implemented as a software product and/or as instructions causing the processor(s) 205 to perform certain functionality.

In one illustrative implementation, various functions of the studio environment 100 are implemented as software code and loaded into working memory 240. Upon execution of the code, computations are performed by the CPU(s) 205, and various data are stored (e.g., on computer readable media, such as storage device(s) 220 or computer readable storage media 225*b*). As illustrated, the functions implemented as software products can include MIDI sequencer 105 functionality, inferential control generator 115 functionality, "soft" MIDI instrument 130 functionality, etc.

It should be appreciated that alternate embodiments of a computer system 110*a* may have numerous variations from that described above. For example, customized hardware might also be used and/or particular elements might be implemented in hardware, software (including portable software, such as applets), or both. Further, connection to other computing devices such as network input/output devices may be employed. Software of the computer system 110*a* may include code for implementing embodiments of the present invention as described herein.

Figure 3:
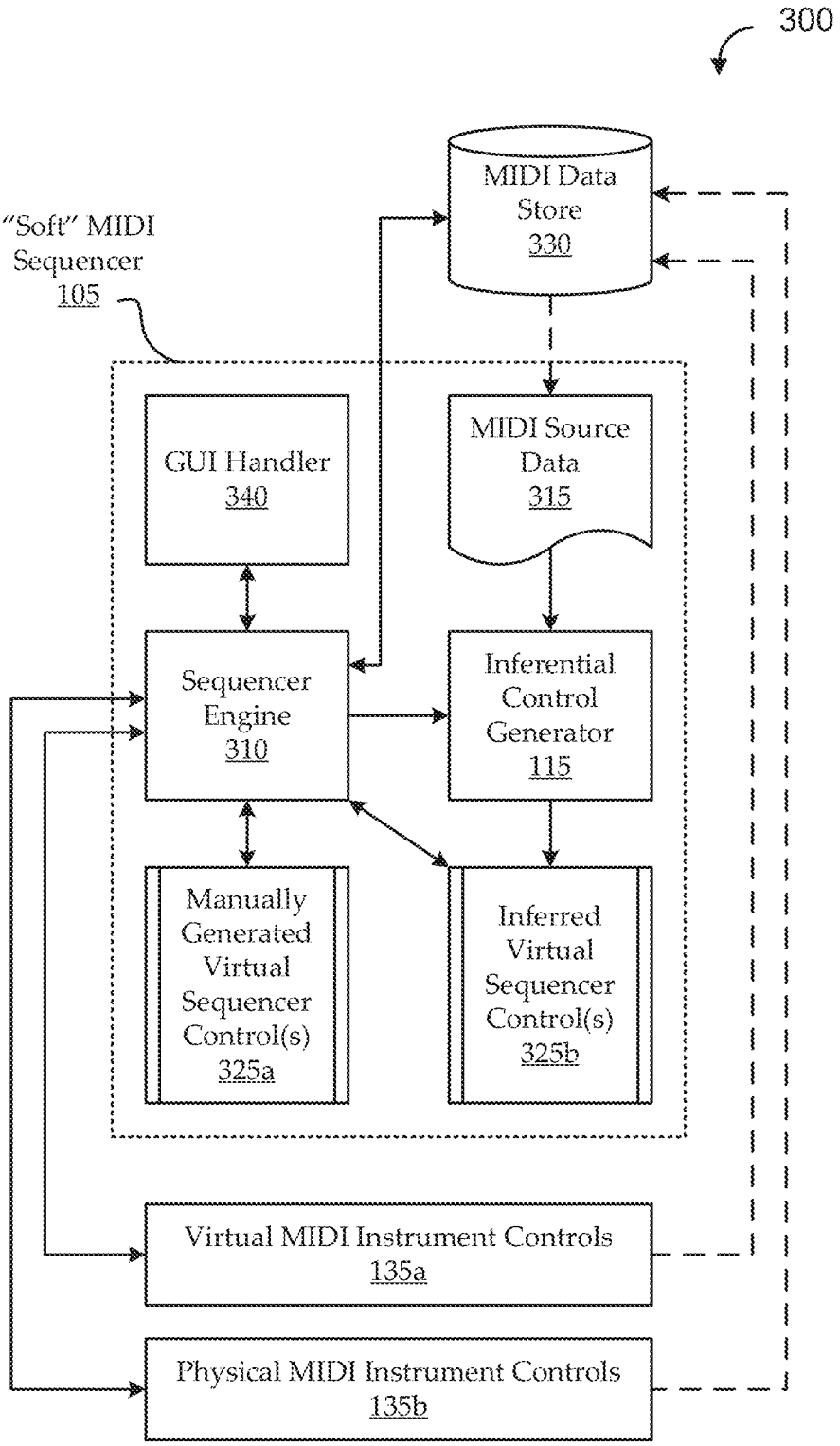
FIG. 3 shows a simplified block diagram of a MIDI automation environment, according to various embodiments.

FIG. 3 shows a simplified block diagram of a MIDI automation environment 300, according to various embodiments. Embodiments of the MIDI automation environment 300 are part of a studio environment, such as the studio environment 100 of FIG. 1. As illustrated, the MIDI automation environment 300 includes a MIDI sequencer 105 (e.g., implemented as a "soft" MIDI sequencer 105 in a computer system 110) in communication with a number of virtual and/or physical MIDI instrument controls 135 (e.g., implemented as part of various virtual and/or physical MIDI instruments 130). The MIDI sequencer 105 also generates and uses data, including MIDI data stored in a MIDI data store 330.

As illustrated, a sequencer engine 310 drives functionality of the MIDI sequencer 105. This functionality typically includes record and playback functions, as supported by a number of functional components (e.g., implemented as separate software products, plug-ins to the MIDI sequencer 105, or in any other useful way). The functional components can include an inferential control generator 115 and a GUI handler 340. Though not shown, any number or types of other functional components can be included in various embodiments.

Embodiments of the MIDI sequencer 105 include a number of virtual sequencer controls 325. Some virtual sequencer controls 325 are manually generated virtual sequencer controls 325*a* (e.g., generated by a user via a user interface of the MIDI sequencer 105, provided by a manufacturer or third-party as part of a plug-in or dedicated software package for the MIDI instrument 130, etc.). Other virtual sequencer controls 325 are inferred virtual sequencer controls 325*b* (e.g., generated by the inferential control generator 115).

In some embodiments, MIDI "songs" are stored in the MIDI data store 330 (e.g., as files or groups of files). As used herein, a MIDI "song" is a sequence of MIDI commands, typically including both note and control command data with respective attributes (e.g., time codes, values, etc.). It is worth noting that a "song" may not always be limited to a set of musical commands. For example, the "song" may, in fact, be a sequence of MIDI commands for controlling lighting and/or video. MIDI songs can be "played" by the MIDI sequencer 105. It will be appreciated that playing the song may involve using the MIDI sequencer 105 to effectively reproduce a performance by automating note and control events through the various MIDI instruments 130 in the studio environment 100.

In an illustrative use case, MIDI source data 315 is received (e.g., as a song, a portion of a song, multiple songs, etc.) from the MIDI data store 330 and/or from other live or recorded sources of MIDI command data. Notably, the MIDI source data 315 may include MIDI commands that were generated by virtual sequencer controls 325 of the MIDI sequencer 105, physical or virtual controls of another sequencer, MIDI instrument controls 135 of one or more MIDI instruments 130, or by any other source of MIDI command data. In some cases, the inferential control generator 115 uses the MIDI source data 315 to infer what controls are present and how they were used to generate the MIDI source data 315, resulting in a set of automatically generated, inferred virtual sequencer controls 325*b*. These inferred virtual sequencer controls 325*b*, along with any manually generated virtual sequencer controls 325*a*, can be used by the MIDI sequencer 105 to automate respective MIDI instrument controls 135 and can be controlled by those respective MIDI instrument controls 135 in some cases). In practice, some or all of the virtual sequencer controls 325 are configured to be interactively controllable by the user through a user interface that is generated and handled by the GUI handler 340.

Figure 4:
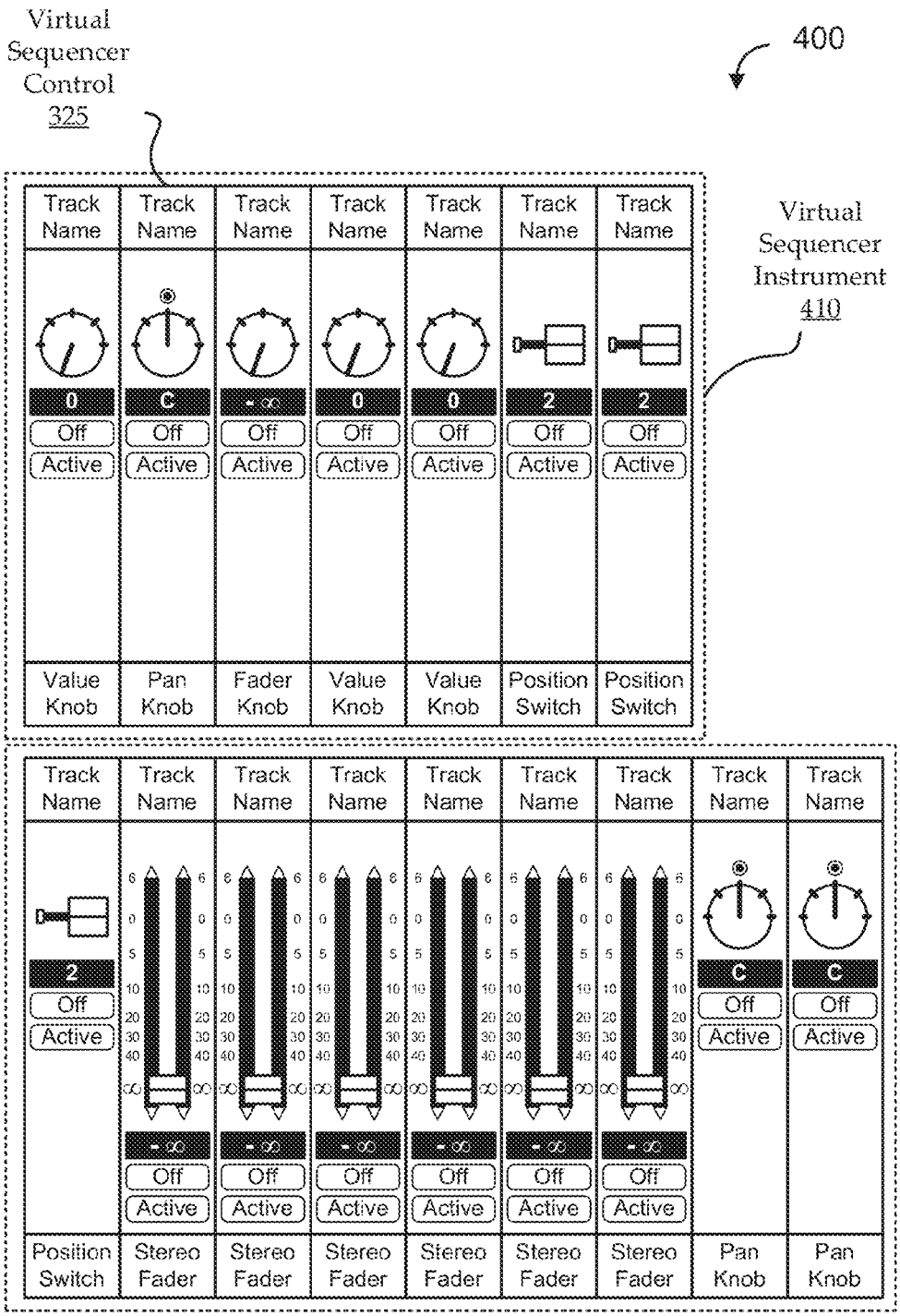
FIG. 4 shows a portion of an illustrative graphical user interface that may be managed by a GUI handler, according to various embodiments.

For the sake of illustration, FIG. 4 shows a portion of an illustrative graphical user interface 400 that may be managed by a GUI handler 340, according to various embodiments. The illustrative graphical user interface 400 includes a stack having two virtual sequencer instruments 410. Each virtual sequencer instrument 410 is a collection of virtual sequencer controls 325. In some implementations, each virtual sequencer instrument 410 corresponds to a physical or virtual MIDI instrument 130 in the studio environment 100. In other implementations, virtual sequencer controls 325 can be arranged and/or combined in other ways (e.g., that do not correspond to any MIDI instrument 130). Embodiments of the GUI handler 340 may also provide various other functions, such as the ability to move, resize, delete, copy, and or otherwise manipulate existing controls; the ability to save controls, instruments, and/or stacks; the ability to perform sequencer functions (e.g., cut, copy, play, record, stop, pause, fast-forward, rewind, snap, quantize, synchronize, etc.); the ability to perform file management functions; etc.

It will be appreciated that the graphical control elements representing the virtual sequencer controls 325 can include any useful type of control and can be made interactive in any useful way. For example, some embodiments include value knobs, pan knobs, fader knobs, position switches, fader sliders (e.g., mono, stereo, quad, octal, etc), Non-Registered and/or Registered Parameter Number (NRPN and/or RPN) controls, etc. Further, each control type can be used to control many types of parameters. For example, a fader slider control can be used to control volume, cross-fading between sounds, reverb delay, vibrato depth, arpeggiation speed, light dimming, frame rate, filter cutoff point, or any other useful parameter. Even further, each control can be made interactive in any useful way. For example, a knob can be controlled by entering a value using a keyboard or keypad, by clicking and dragging with a mouse, by touching and dragging using a touchscreen, by changing proximity between a user's hand and a sensor, or in any other way.

It is worth noting that, in some implementations, a single MIDI instrument control 135 can be automated using multiple virtual sequencer controls 325. In one example, a single, physical MIDI instrument control 135 is configured as part of a MIDI instrument 130 to control four different functions depending on which bank is selected. It may be desirable to use four separate virtual sequencer controls 325 to automate the functions of the single MIDI instrument control 135. In another example, a single, physical MIDI instrument control 135 may be designed to accommodate complex interactivity, like a joystick handle that can move left and right, move up and down, and twist. Each type of motion may control a different parameter and may be automated using a separate virtual sequencer controls 325 (e.g., where a single virtual sequencer control 325 having similar capabilities is not available).

Embodiments support extended control types, including RPN and NRPN controls and system exclusive ("sysex") messages. The MIDI specification limits the number of available controls (e.g., particularly continuous controls). Some manufacturers use sysex commands to edit certain control parameters. Another approach is to use RPN and NRPN controls, a technique provided in the MIDI specification to extend the set of numbers available for assignment to controls. In particular, RPN and NRPN controls each involve sending four control messages, two to select which control parameter is being edited and two to set the value. Various manufacturers use RPN and NRPN to extend their control capabilities NRPN can offer 16,384 possible values instead of only 128). Embodiments detect RPN and NRPN control messages and can infer RPN and NRPN controls, accordingly.

Some embodiments are described further with reference to the methods of FIGS. 5-10, below. For the sake of clarity, these methods are described in context of the various system embodiments described above. However, the system embodiments are intended only to illustrate some ways of enabling various embodiments, and it will be appreciated that many other implementations are possible. For example, many types of studio configurations are possible with many different types of instruments, those instruments can be controlled in many ways, those controls can be automated to many different degrees in many different ways, etc. Accordingly, references to specific implementations are intended to be illustrative and should not be construed as limiting the scope of embodiments.

Figure 5:
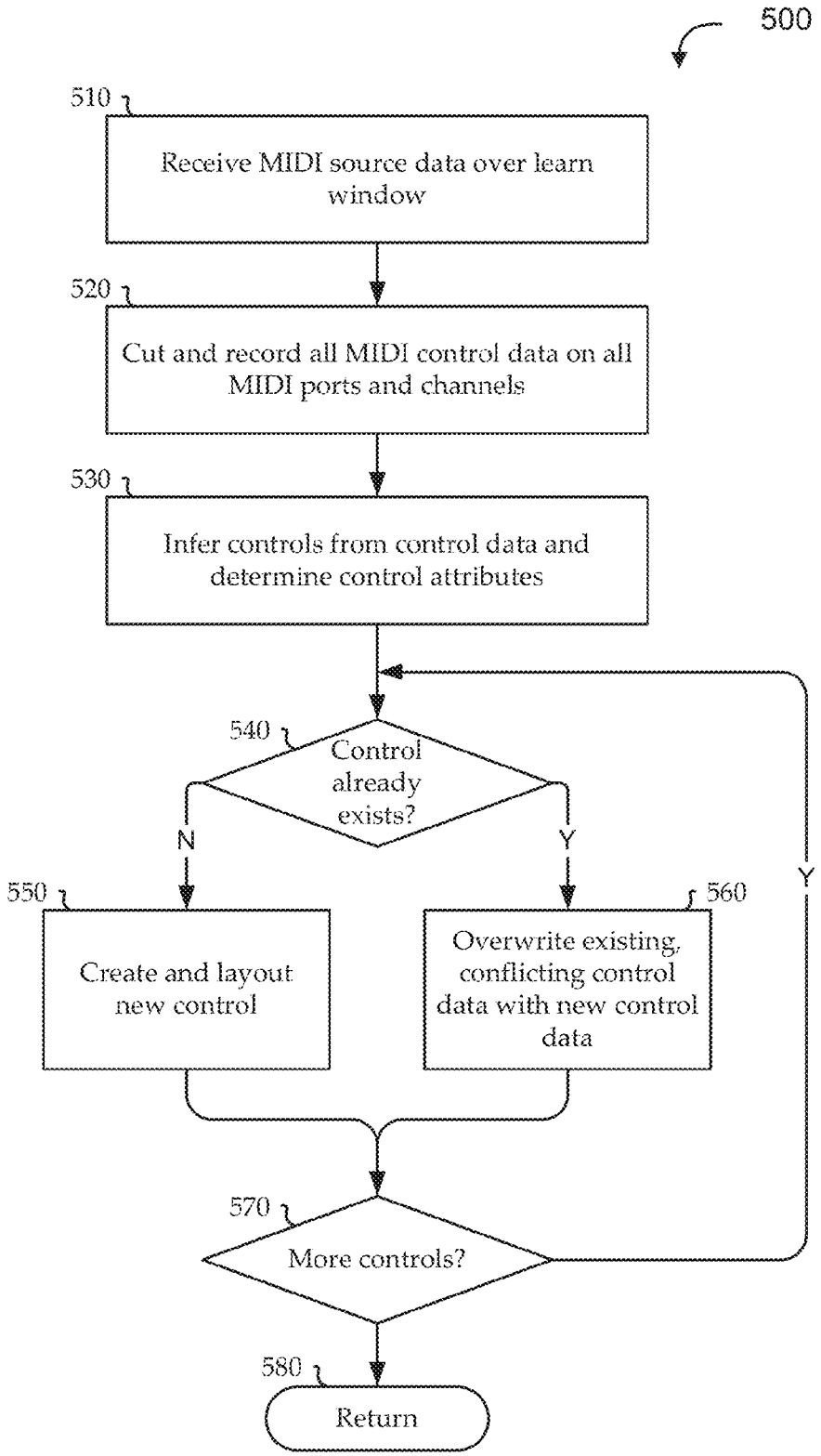
FIG. 5 shows a flow diagram of an illustrative method for inferring MIDI controls, according to various embodiments.

Turning to FIG. 5, a flow diagram is shown of an illustrative method 500 for inferring MIDI controls, according to various embodiments. Embodiments of the method 500 may occur when a "MIDI learn" mode is entered for inferring MIDI virtual sequencer controls 325 from a selected set of MIDI source data 315. Embodiments may support a number of different "MIDI learn" modes (e.g., or ways of invoking the functionality of "MIDI learn"). For example, the different MIDI learn modes may include a mode that automatically generates volume, pan, and other controls from any embedded data upon receipt of a sequence of MIDI command data; a mode that automatically generates volume and pan controls only upon receipt of a sequence of MIDI command data; a mode that automatically generates any embedded data controls only (i.e., no automatic volume and pan generation) upon receipt of a sequence of MIDI command data; and modes that allow manual generation of volume and pan controls, any embedded data controls, or both using a received sequence of MIDI command data. In some embodiments, the method 500 begins at block 510 by receiving MIDI source data over a learn window. For example, referring to FIG. 3, MIDI source data 315 is received from the MIDI data store 330 and/or from other live or recorded sources of MIDI command data as a sequence of MIDI commands. The sequence of MIDI commands includes note data and control data.

The MIDI source data 315 can be generated in any useful way. For example, the MIDI source data 315 can include MIDI commands that were generated by virtual sequencer controls 325 of the MIDI sequencer 105, physical or virtual controls of another sequencer, MIDI instrument controls 135 of one or more MIDI instruments 130, or by any other source of MIDI command data and stored to the MIDI data store 330. The data can then be retrieved upon entering the "MIDI Learn" mode. In other implementations, some or all of the MIDI source data 315 can be generated subsequent to entering the "MIDI Learn" mode.

Suppose, according to a first illustrative use case, that it is desired to automatically generate inferred virtual sequencer controls 325 to automate all the MIDI instrument controls 135 of a particular MIDI instrument 130 in a studio environment 100. The MIDI sequencer 105 is set to "record," such that it can receive MIDI commands through multiple channels, ports, etc. A user then begins to interact with the MIDI instrument controls 135 of the MIDI instrument 130. For example, the user can twist each knob, slide each slider, switch each switch, etc. The user may desire to move each control through its full extents (e.g., from its highest to its lowest value or position) or only through part of its extents. The user may also perform bank switching to interact with multiple functions of the same MIDI instrument control 135 (e.g., slide a fader up and down, switch to another bank corresponding to a different fader function, and slide the fader up and down again). All the MIDI commands generated from the user's manipulations of the MIDI instrument controls 135 are recorded as a "song" in the MIDI data store 330. In a related, illustrative second use case, after entering "MIDI Learn" mode, the sequencer may prompt the user (or otherwise indicate) to begin manipulating the MIDI instrument controls 135, for example, as described in the previous implementation. For instance, the MIDI sequencer 105 enters a special or general record mode in response to entering the "MIDI Learn" mode. In either of the above use cases, the result of the user's manipulation of the MIDI instrument controls 135 is effectively a sequence of MIDI commands, which can be stored (e.g., in the MIDI data store 330 or in other volatile or non-volatile storage). In a third illustrative use case, it is desired to automatically generate inferred virtual sequencer controls 325 to automate any MIDI controls used in the recording of a song. It will be appreciated that embodiments can effectively treat this third use cases in the same way as the previous use cases, as the song data again includes a sequence of MIDI commands.

In some cases, the MIDI source data 315 is selected by selecting a file name, a set of files, a path, etc. In some embodiments, a window is also selected. For example, an interface (e.g., a GUI, command line or other interface) may be provided for selecting the window in various ways, including "Entire Song Time" (for selecting a window that spans the entire song), "Between Locations" (for selecting a window defined by predetermined labels, indexes, punch in and punch out times, or other types of locations), "Between Times" (for selecting a window defined according to starting and/or ending time codes, or other time identifiers), "Between Bars/Beats" (for selecting a window defined according to starting and/or ending measure numbers, bar numbers, beat numbers, etc), for certain tracks (for receiving data applicable only for particular tracks), etc. Having selected the learn window, the relevant MIDI source data 315 is now the sequence of MIDI commands that are effective during that window.

At block 520, all MIDI control data on all MIDI ports and channels is parsed from the learn window portion of the MIDI source data 315. Depending on how the MIDI source data 315 was generated, its sequence of MIDI commands may include both note and control data. Further, the control data may include data for MIDI instrument controls 135 that the user does not desire to automate (e.g., or to re-automate, if for example, a particular MIDI instrument control 135 was previously automated and the user wants to ignore any changes to that control's data). In either case, the control data parsed at block 520 may include only a portion of the sequence of MIDI commands found within the learn window of the MIDI source data 315.

Figure 6:
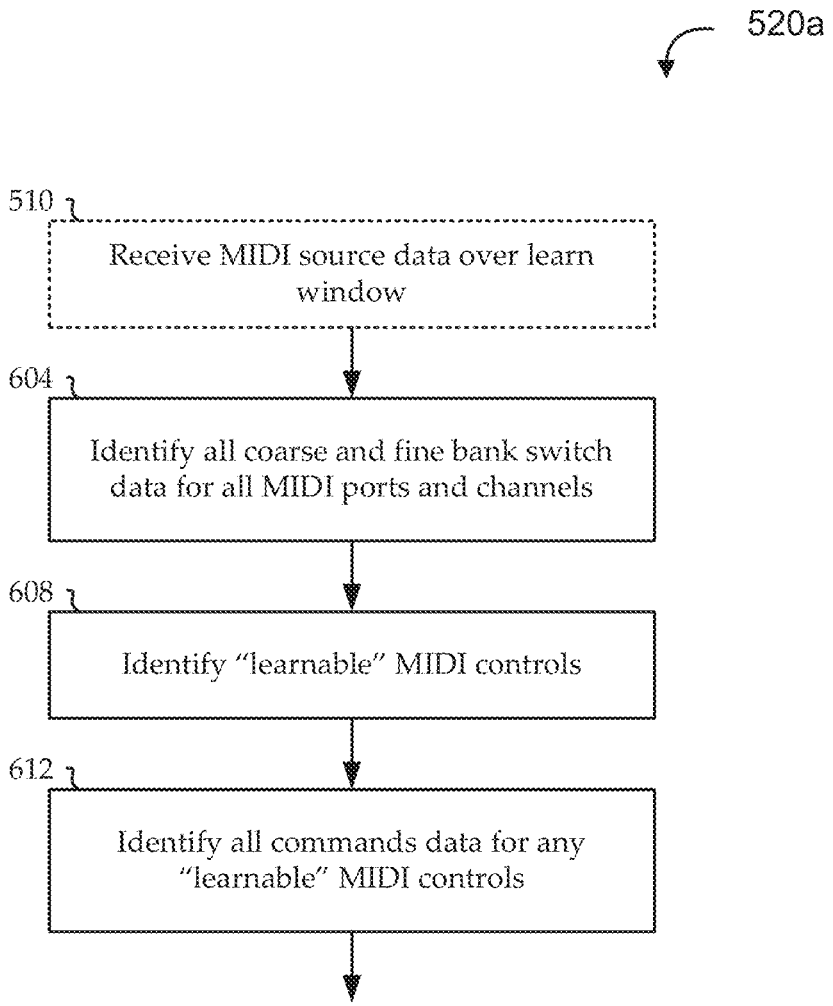
FIG. 6 shows a flow diagram of an illustrative method for parsing desired MIDI control data from the MIDI source data, according to various embodiments.

Moving temporarily away from FIG. 5, FIG. 6 shows a flow diagram of an illustrative method 520*a* for parsing desired MIDI control data from the MIDI source data 315, according to various embodiments. Block 510 is shown for the sake of context. Embodiments of the method 520*a* begin at block 604 by identifying bank switch data for MIDI ports and channels. Some implementations identify all coarse and fine bank switch data for all MIDI ports and channels, while other implementations allow selection of only subsets of bank switches (e.g., only coarse batik switching), ports, and/or channels to be identified.

For example, MIDI control commands may be received and recorded as part of the MIDI source data 315 from a number of different MIDI channels via a number of different MIDI ports. Identifying which commands were received through which port and channel can indicate, at least partially, which control of which instrument sent the command. It may be further desirable to determine which program (e.g., which patch, etc.) is being controlled by that MIDI instrument control 135. This can also be determined from the MIDI commands, for example, from a MIDI "Program Change" message. Because the "Program Change" message only typically supports 128 values (i.e., switching between 128 programs), additional messaging is needed in the MIDI specification to allow a MIDI instrument 130 to support switching between more than 128 programs. This additional messaging, "Bank Select" or "Bank Switch," can include coarse and/or fine switching between banks of 128 programs. In one example, a drum kit may include up to 128 different percussion sounds, and bank switching can be used to switch between drum kits. In another example, a synthesizer supports 512 programs, which it may divide into four banks of 128 programs each. It is worth noting that a bank switch command does not typically cause a program change to occur. Rather, a bank switch command effectively goes into effect when the next program change command occurs. For example, switching from program "1" to program "129" would involve sending a bank switch command to switch to the second bank, followed by a program change command to switch to the first program (in that new bank).

It will be appreciated from the above that a single MIDI instrument control 135 may control parameters of many different programs (e.g., which may be considered as separate tracks, or the like) due to bank switching, even though the commands are being communicated over the same channel and port. Similarly, NRPN and/or RPN commands, and or other commands can expand the functionality of a particular MIDI instrument control 135. Accordingly, a single MIDI instrument control 135 may manifest multiple and/or extended control functions. As such, it may be desirable to create multiple virtual sequencer controls 325 to automate each of the various control functions.

For example, various functions described herein can involve banks, bank switching, Non-Registered and/or Registered Parameter Number (NRPN and/or RPN) controls, system exclusive ("sysex") messages, and the like for support of more advanced types of instrument control. Many larger and/or inure sophisticated MIDI instruments have more of a particular type of control than the number of supported MIDI channels. For example, while there may be a maximum of only 16 supported MIDI channels (channels 0-15), a particular MIDI instrument may have 24 volume controls. Such an instrument can use bank switching to support the controls, for example, by assigning volume controls 1-8 to channels 0-7 of a "Bank 0," assigning volume controls 9-16 to channels 0-7 of a "Bank 1," and assigning volume controls 17-24 to channels 0-7 of a "Bank 2." The MIDI specification supports a coarse bank command and a fine bank command, thereby potentially supporting up to 128 banks using only coarse bank switching (some MIDI instruments only support coarse bank switching), or up to 16,384 banks using both coarse and fine bank switching (i.e., each command is typically associated with a 7-bit value, so that coarse and fine bank switching can support up to 2^14 banks). Some larger and/or more sophisticated instruments can also support additional types of controls. For example, as described above, the MIDI specification limits the number of available controls (e.g., particularly continuous controls), and various manufacturers exploit sysex controls, RPN and NRPN controls, and/or other techniques provided in the MIDI specification to extend the set of numbers available for assignment to controls (e.g., NRPN can offer 16,384 possible values instead of only 128).

When inferring controls and/or performing other functions described herein, it can be desirable to monitor and track these extended MIDI functions. Taking advantage of these extended functions of the MIDI specification typically involves sending a respective MIDI control command. For example, switching from "Bank 0" to "Bank 1" can involve a MIDI command having a byte to indicate that a control command is being sent and channel over which it is being sent, a byte identifying the control command, and a byte indicating the value associated with the control command (e.g., represented in hexadecimal, "0xBF00 01" can indicate that a control command ("B") is being sent over channel 15 ("F"), the control command is a coarse bank switch ("00"), and the bank is being switched to "Bank 1" ("01"); while "0xB1 07 64" can indicate that a control command ("B") is being sent over channel 1 ("1"), the control command is a volume control ("07"), and the volume value is being changed to 100 ("64")). Suppose, for example, that, during MIDI learn mode, the instrument described above with 24 volume controls sends volume information for "volume control 2" on channel 1 (bank 0), followed by a bank switch command to switch to bank 1, followed by volume information for "volume control 10" on channel 1 (bank 1). In implementations that do not monitor and track bank switch commands, the MIDI sequencer 105 may see two sets of volume information being received over channel 1, and infer a single MIDI virtual sequencer control 325 for the volume information from the set of MIDI source data 315. Similarly, when using virtual controls of the MIDI sequencer 105 to control that instrument's volume controls, a lack of support for bank switch commands may limit the ability of the MIDI sequencer 105 to control more than say eight of the instrument's volume controls. Accordingly, embodiments monitor and track bank switch (and/or other extended MIDI) commands to determine the impact of those commands on the control data and operation, as described more fully below.

Further, some instruments support extended MIDI commands on different channels from those used for the associated instrument control. Embodiments support channel mapping, which facilitates mapping (e.g., a priori) of extended MIDI control information to specific channels for MIDI sequence data associated with a particular port. Implementations of the channel mapping functionality can provide a number of features. One such feature is that the channel mapping scheme (e.g., for bank switch commands, RPM/NRPM commands, and/or other extended MIDI functions) can pre-configure the channel that will be associated with a received control command channel for a specific MIDI port (i.e., embodiments can provide port-specific channel mappings). For example, the particular MIDI instrument described above sends volume control information over channels 0-7, and it may send bank switch commands for the volume controls over channel 15. In such an example, proper operation of the MIDI sequencer 105 can involve recognizing that a bank switch command received on channel 15 (e.g., for the particular port associated with that instrument) is intended to change the bank associated with volume control information received over channels 0-7. Another such feature of some channel mapping implementations is support for default or library channel mappings. For example, by default, the bank switch channel can be associated with the same channel as the instrument control channel (e.g., when instrument control data is detected in the MIDI source data 315 on a particular channel, a MIDI virtual sequencer control 325 is inferred and the inferred control is set by default to look for bank switch information on the same channel). Alternatively, a library of channel mappings can be provided that includes preset channel mappings for particular instruments (e.g., make and/or model specific), instrument types or categories, common presets, etc. The library can be generated in any suitable manner and by any suitable party (e.g., as a pre-loaded library, by supporting manufacturer downloads or plug-ins, by supporting definitions generated and saved by end users, etc.). Rather than using defaults, libraries, etc., embodiments permit users to manually set up channel mappings, for example, according to instrument-specific mapping information indicated by an instruction manual, or the like. Some implementations include an interface (e.g., GUI) that permits users to change channel mappings, by control type, port, MIDI channel, etc.

Figure 11:
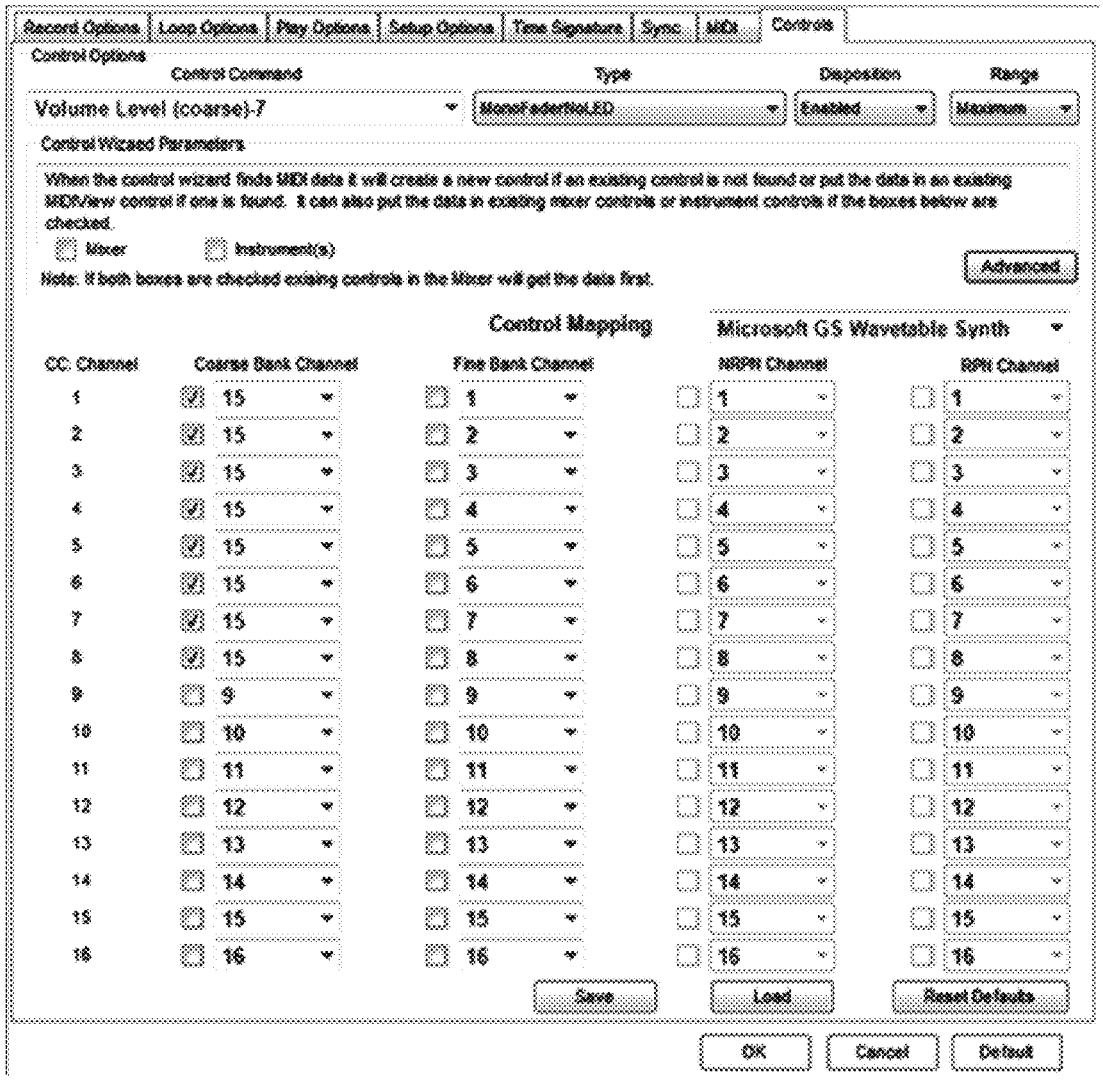
FIG. 11 shows an example of a graphical user interface (GUI) for implementing channel mapping functionality as part of an application, according to various embodiments.
Figure 12:
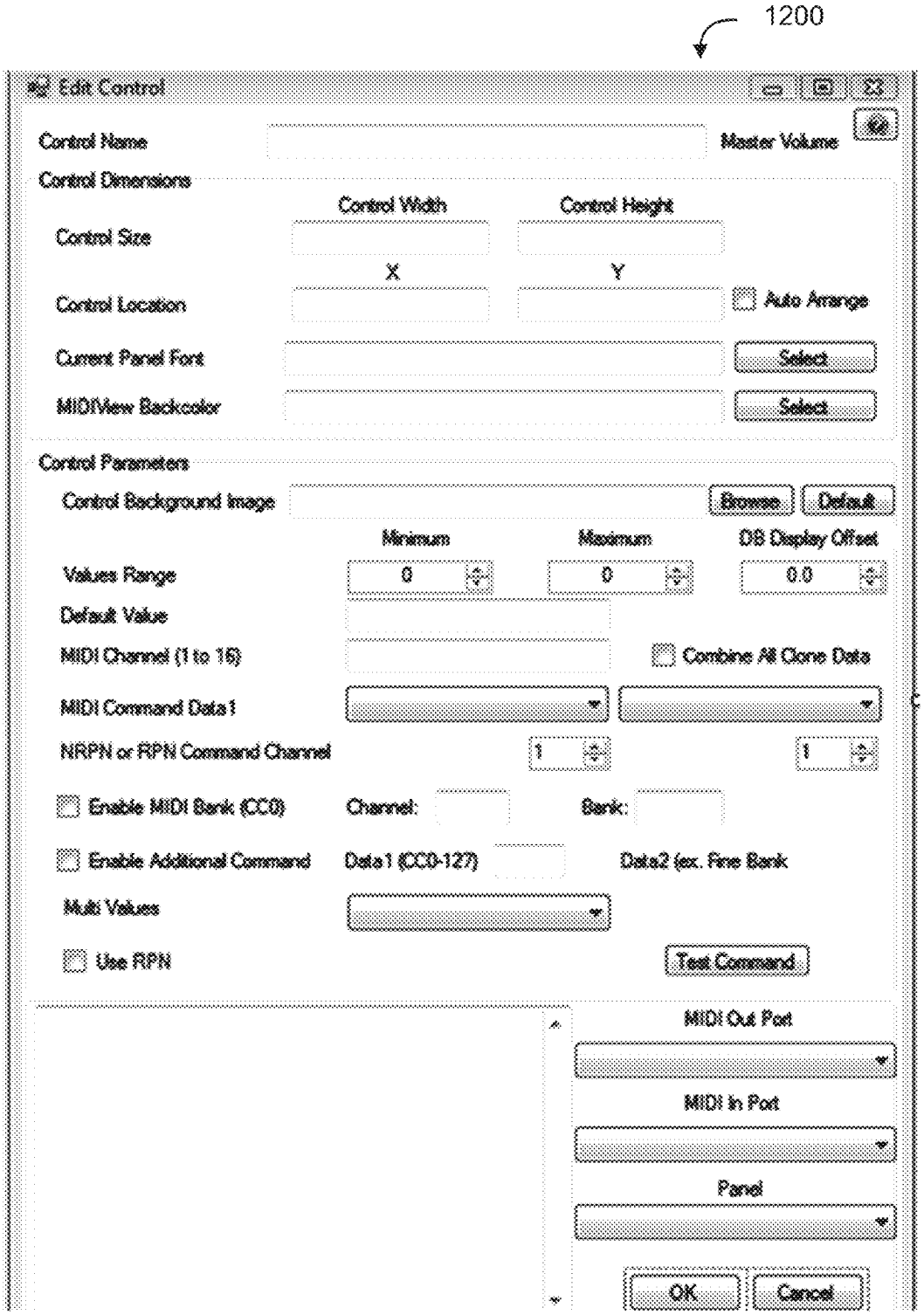
FIG. 12 shows another example of a GUI for implementing channel mapping functionality as part of an application, according to various embodiments.

To illustrated some of these channel mapping functions, FIGS. 11 and 12 provide illustrative interface environments.

FIG. 11 shows an example of a graphical user interface (GUI) 1100 for implementing channel mapping functionality as part of an application, according to various embodiments. The GUI 1100 permits interactive adjustment and visualization of a number of different types of channel mapping information relating to MIDI instrument controls. A portion of the GUI 1100 can indicate a particular type of instrument control associated with the displayed parameters. Some implementations include a drop-down menu or other interactive GUI element that permits selection of any desired control type. For the sake of illustration, an upper portion of the GUI 1100 shows parameters for a selected coarse volume level control (e.g., MIDI control command 07).

Some implementations of the GUI 1100 can also permit selection of a particular port associated with the instrument having the control being mapped. As described above, in some embodiments, channel mapping can be identified by particular types of control information, by channel, and/or by port. In this way, the MIDI sequencer 105 can concurrently interface with (e.g., control, learn from, be controlled by, etc.) multiple instrument controls on multiple instruments using different channels and ports. For the sake of illustration, the GUI 1100 shows a "Control Mapping" field that indicates the port being mapped or an instrument associated with that port.

Another portion of the GUI 1100 can indicate present channel mappings and/or allow those channel mappings to be adjusted. The illustrated channel mapping shows that, for coarse volume control commands associated with channels 1-8 of the selected port, associated coarse bank switch commands are mapped to channel 15. This can indicate, for example, that coarse bank switch commands sent on channel 15 are used by the particular instrument to bank switch all the volume level controls on channels 1-8 (e.g., to shift from one set of 8 volume controls to another set of 8 volume controls). The illustrated channel mapping also shows that each of the associated fine bank switch commands and RPN/NRPN commands are mapped to the same channels as the respective volume level control commands. This can indicate a deliberate mapping, or this can indicate a default or other mapping (e.g., this can be the default for controls that do not use fine bank switching, RPN/NRPN controls, etc.). Some embodiments of the GUI 1100 include additional information about the channel mapping, controls, etc. For example, in the illustrated embodiment, the checkbox in each of the mapping rows associated with channels 1-8 can indicate that the mapping is active (e.g., that such a control "exists" from the perspective of the application), and the font (e.g., color, style, etc.) of each "15" in the "Coarse Bank Channel" column can indicate that an associated virtual sequencer control has not yet been created (e.g., a physical control is expected to exist, and mapping information has been created, but no corresponding virtual control has been manually or inferentially generated). Any other suitable types of information and/or interactive elements can be included. For example, some implementations permit the user to load, save, and/or browse channel mappings.

FIG. 12 shows another example of a graphical user interface (GUI) 1200 for implementing channel mapping functionality as part of an application, according to various embodiments. The GUI 1200 represents a window through which parameters of a particular virtual control can be edited. As illustrated, the GUI 1200 permits editing of many suitable types of control-related information, such as aesthetic features (e.g., size, location, font, color, etc,), standard control data features (e.g., values range, control MIDI channel, etc.), and extended MIDI command features (e.g., relating to channel mapping). One such channel mapping-related feature is illustrated as "NRPN or RPN Command Channel" (and related controls), which can permit an NRPN and/or RPN channel to be mapped in association with the control. Another such channel mapping-related feature is illustrated as "Enable MIDI Bank" (e.g., and related controls), which can permit bank switching and related channel mapping to be enabled in association with the control.

The channel mappings can impact other functions, such as when inferring virtual controls from incoming MIDI data (e.g., according to the MIDI learn mode functions described herein), when using virtual controls to manipulate physical instrument controls, etc. Suppose, for example, that a channel mapping is set up for a particular MIDI instrument on a particular port that has twenty volume controls and twenty pan controls, each arranged in two banks of ten controls. According to the example channel mapping, volume and pan information is received on channels 1-10, bank switch commands for volume are received on channel 15, and bank switch commands for pan are received on channel 14. MIDI source data 315 is received that includes: for a first five seconds, volume and pan control information on channel 1; at five seconds, a bank switch command on channel 15; for the next two seconds, more volume and pan control information on channel 1; at seven seconds, a bank switch command on channel 14; and for the next three seconds, more volume and pan control information on channel 1. According to the example channel mapping and the illustrative MIDI source data 315, a first volume control (e.g., "Volume 1") can be inferred that receives volume control information on channel 1 (bank 0) and is associated with the volume control data received during the first five seconds, a second volume control (e.g., "Volume 11") can be inferred that receives volume control information on channel 1 (bank 1) and is associated with the volume control data received during the last five seconds (i.e., after the bank switch command is received on channel 15), a first pan control (e.g., "Pan 1") can be inferred that receives pan control information on channel 1 (bank 0) and is associated with the pan control data received during the first seven seconds, and a second pan control (e.g., "Pan 11") can be inferred that receives pan control information on channel 1 (bank 1) and is associated with the pan control data received during the last three seconds (i.e., after the bank switch command is received on channel 14). Similarly, according to the preceding example, when a user manipulates the virtual "Volume 1" control, a bank switch command can be sent over channel 15 to the physical MIDI instrument if needed) to switch to bank 0, followed by volume control information sent over channel 1; and when a user manipulates the virtual "Volume 11" control, a bank switch command can be sent over channel 15 to the physical MIDI instrument (e.g., if needed) to switch to bank 1, followed by volume control information sent over channel 1.

Typically, extended MIDI commands (e.g., channel mapping-related commands, like bank switch, etc.) apply over time windows. Further, many MIDI instruments are configured only to send extended MIDI commands only when a change is needed, not every time an affected control is manipulated. Suppose physical controls "Volume 1" through "Volume 8" are on bank 0, and physical controls "Volume 9" through "Volume 16" are on bank 1. Suppose further that the user manipulates physical controls "Volume 1" and "Volume 2" for ten seconds, and then manipulates physical controls "Volume 9" and "Volume 10" for the next ten seconds. Some MIDI instruments can send a single bank switch command after the first ten seconds, rather than sending potentially redundant bank switch commands when each volume control is manipulated. Accordingly, embodiments operate to apply bank switch commands and/or other extended MIDI controls, as appropriate, over applicable time windows. For example, when inferring controls, time windows can be used to determine whether data received on a same channel should apply to one control or to multiple controls (i.e., on multiple banks). Additionally, or alternatively, some embodiments use time windows when generating MIDI control data. Suppose virtual controls "Volume 1" through "Volume 8" are on bank 0, and physical controls "Volume 9" through "Volume 16" are on bank 1. Suppose further that the user manipulates virtual control "Volume 1," followed by "Volume 2, followed by "Volume 9." Some implementations can send a bank switch command in front of the volume control data for "Volume 1," not send a bank switch command in front of the volume control data for "Volume 2" (because "Volume 2" is on the same bank as "Volume 1"), and send another bank switch command in front of the volume control data for "Volume 3" (because "Volume 3" is on a different bank than "Volume 2" and "Volume 1").

Some embodiments use various techniques, including the time windows functionality described above, to reduce and/or otherwise optimize the data being exchanged over the MIDI communications link (e.g., channel and port). Overloading the MIDI communications channels can tend to reduce performance, increase errors, etc. Embodiments include a novel packetizing scheme that facilitates compressed handling of MIDI data within application packets by including channel mapping information relating to MIDI control data, such as indicating bank switching channels, banks, NRPN/RPN command channels, etc. This type of packetizing can improve application performance by reducing the amount of data being exchanged over the MIDI communications links, while helping to ensure that bank channels, banks, NRPN/RPN channels, NRPN/RPN commands, and the like are exchanged substantially as needed (e.g., not redundantly, etc.). In some implementations, a MIDI output driver for the application monitors outgoing data and can utilize the compressed packets to determine whether the MIDI control data can be correctly interpreted without associating an extended MIDI command (e.g., a bank switch, NRPN/RPN, or other similar type of command). Certain embodiments only send the extended MIDI command when it is determined to be necessary (e.g., in an absolute sense or in a relative or probabilistic sense) for correctly interpreting the MIDI control data. For example, when determined to be necessary, the output driver can send the exact bank, NRPN/RPN command, etc. to the associated MIDI channel and MIDI port before the respective control data is sent. Some implementations also apply the scheme to "MIDI Thru" information to monitor affected extended MIDI commands on specific channels and ports. The scheme can avoid sending redundant and/or otherwise unnecessary information over the MIDI communications channels each time MIDI control data is sent.

Returning to FIG. 6, identifying coarse and fine bank switch data for all MIDI ports and channels at stage 604 can include identifying any types of "extended MIDI" types of controls, such as bank switching, NRPN/RPN, and/or other commands, and/or identifying applicable windows for applying those commands. In some implementations, as the MIDI source data 315 is received, extended MIDI commands can be buffered or otherwise stored in a manner that facilitates later application to associated MIDI control data at appropriate times. For example, the extended MIDI commands can be stored along with a respective timestamp (e.g., the timing of the MIDI command in relation to the MIDI source data 315) and a respective channel (e.g., the channel over which the command is received). When instrument control data is received (e.g., volume control data), embodiments can determine whether there are any applicable, previously buffered extended MIDI commands that should be applied to the instrument control data (e.g., for inferring a new control, for manipulating the proper control, etc.). For example, it can be determined whether there is a previously buffered bank switch, NRPN/RPN, and/or other command for the port, control type, time frame, and MIDI channel of the instrument control, and also whether the channel of the extended MIDI command is appropriate according to a channel mapping for the instrument control.

In one implementation, the source data is analyzed twice. In the first analysis, an array (e.g., "array 1") can be compiled with all the bank numbers (e.g., fine and coarse) and NRPN/RPN parameters numbers (e.g., using command changes CC:99 though CC:101), the port and midi channel on which each is sent, and a range of applicable times (e.g., an applicable window) for each. After this array data is compiled, a second analysis of the source data can be used to identify (e.g., and compile) the control commands (e.g., pan, volume, fine and coarse data entry values used NRPN/RPN commands, etc.). The identified control commands can be used to identify unique, corresponding, virtual sequencer controls. To that end, preceding data on banks and NRPN/RPN can be consulted to find an appropriate bank (e.g., or for data entry commands, an appropriate NRPN/RPN command parameter number) by comparing "array 1" data to a current port, and consulting the channel map data to find which data command channels (e.g., the channels for volume, pan, data entry, etc.) are mapped to an appropriate bank channel (e.g., for volume, pan, etc.) or NRPN/RPN command channel (e.g., for data entry commands) for the time range of the underlying volume, pan, data entry, etc. command. This mapping can be used to associate the appropriate bank or NRPN/RPN command parameter number for the data entry commands with the corresponding virtual sequencer control using the data compiled in "array 1." If a unique control using all these associated parameters has already been identified, the data value and time can be added to an array of data values and times for that control. If the associated parameters have not already been identified with a unique control, a new virtual sequencer control with these parameters can be established, and the data value at the appropriate time is the first data value and time can be associated with the virtual sequencer control. As described below, after the controls are created, some implementations delete all the supporting data from the source data. It is noted that, while the above two-stage analysis is intended for use in non-real-time processing contexts (e.g., when a source data file is received, or source data is otherwise post-processed), the techniques can be modified for use in real-time processing and/or other contexts.

Some embodiments allow a user to select which controls are "learnable." At block 608, the set (or subset) of "learnable" MIDI controls is identified. According to one example, it may be desirable to infer virtual sequencer controls 325 only for controlling volume and pan of each program. According to another example, coarse volume control (e.g., control command #7) is "learnable," while fine volume control (e.g., control command #39) is not "learnable" (i.e., allowing for a maximum resolution of only 128 volume levels). In one embodiment, a user interface menu is provided that allows a user to configure control options. For each MIDI control command, the user may be able to configure whether the control command is "learnable," what type of virtual sequencer control 325 should be generated by default when that control is inferred, whether the range should be determined from the data or by some default (as explained more fully below), etc.

At block 612, embodiments identify which MIDI commands correspond to "learnable" controls. For example, the MIDI source data 315 may include note and control command data for an entire song. Identification of a learn window may reduce the relevant MIDI source data 315 to only those control commands that occur during a particular timeframe. Identification of a subset of "learnable" controls can further reduce the relevant MIDI source data 315 to only those control commands that occur during the timeframe of the learn window and correspond to "learnable" controls.

Returning to FIG. 5, the relevant portion of the MDI source data 315 has now been parsed. At block 530, the relevant portion of the MIDI source data 315 is used to infer proposed virtual sequencer controls 325 from the control data and to determine attributes for those proposed controls. Bank switches, program changes, ports, channels, and/or other information are used to determine which MIDI commands from the sequence of commands in the MIDI source data 315 correspond to which proposed controls.

Figure 7:
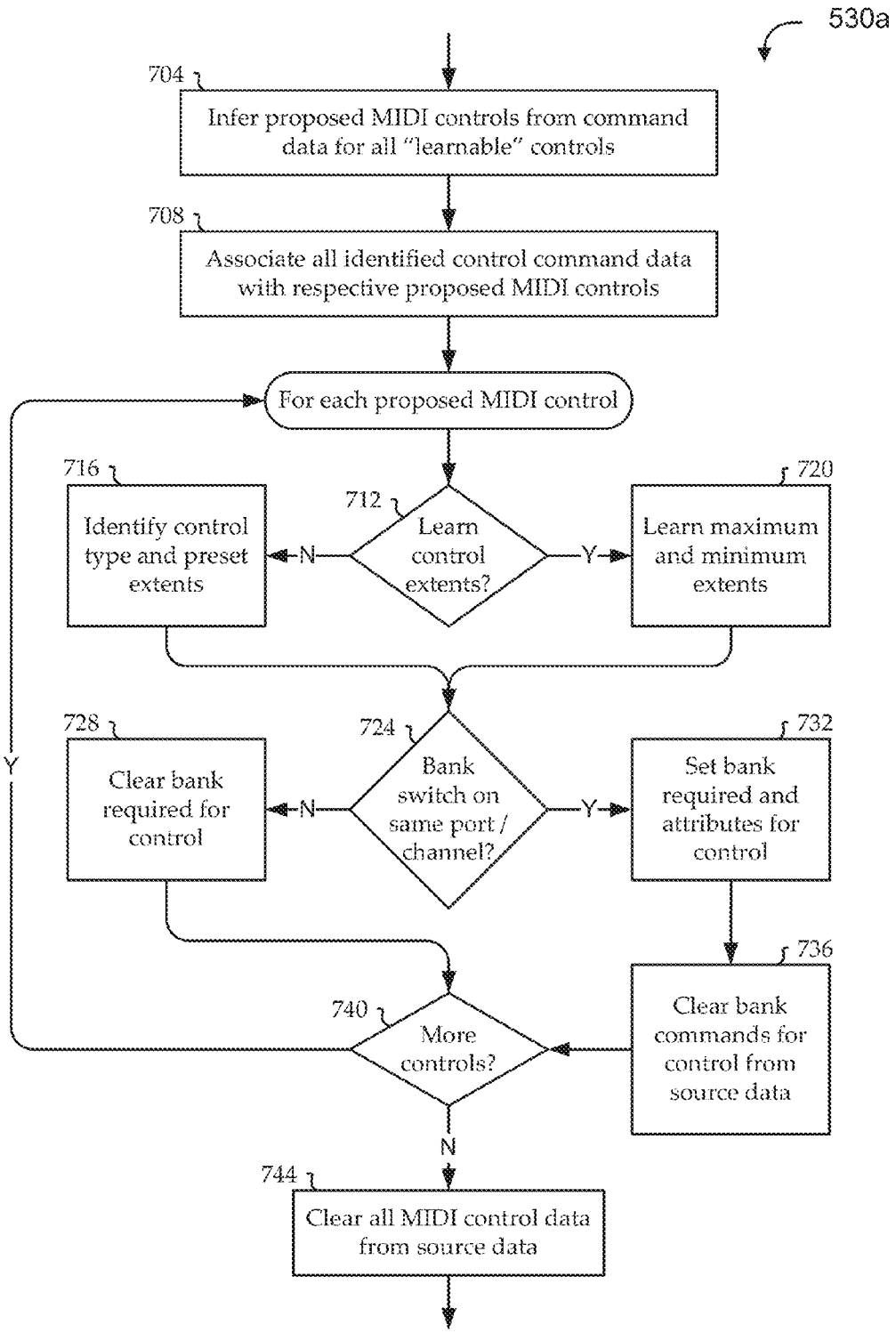
FIG. 7 shows a flow diagram of an illustrative method for inferring proposed virtual sequencer controls from the MIDI source data, according to various embodiments.

Moving again temporarily, away from FIG. 5, FIG. 7 shows a flow diagram of an illustrative method **530*a* for inferring proposed virtual sequencer controls 325 from the MIDI source data 315, according to various embodiments. At block 704, as discussed above, proposed MIDI controls are inferred from the MIDI command data of the relevant portion of the MIDI source data 315 for all "learnable" controls. All identified control command data can then be associated with respective proposed MIDI controls at block 708. For example, each proposed virtual sequencer control 325** can be stored as a sequencer object having associated sequencer data, and the sequencer data can include the identified corresponding sequence of MIDI control commands.

It is worth noting that some embodiments only infer certain types of controls by default. For example, a "Simple Learn Mode" may be provided for only learning volume and pan controls. According to certain embodiments, volume and/or pan controls are automatically inferred for any identified program change. Suppose that a MIDI song includes five different instruments (i.e., five MIDI "programs" or "patches"), but the user who recorded the song only changed the volume of a first one of the instruments during the recording (e.g., the other instruments were played on a velocity-sensitive keyboard, with constant volume, etc.). Inferring data from the sequence of MIDI commands may indicate a volume control associated only with the first instrument, but note data (and/or other data) for four additional instruments. Some embodiments will infer a volume and/or pan control for all five instruments, even when none of the source command data indicates volume or pan control changes.

Embodiments of the method **530*a* may iterate through a number of blocks to infer control attributes and determine additional controls. At block 712, a determination is made for each control as to whether the extents of that control should be learned. As discussed above, an interface may be provided through which a user can select whether the control extents should be learned or set by default. In alternate embodiments, certain control types may always have learnable extents and others may always be set to default values. If it is determined that the control extents should not be learned, default values may be retrieved and associated with the proposed control at block 716. For example, if a potential volume control is identified, the default values may be a minimum of no volume and a maximum of 100-percent volume (e.g., corresponding to coarse volume control values between #1 and #128). If it is determined at block 712 that the extents should be learned, minimum and maximum values can be identified from the MIDI source data 315 and assigned to the proposed control at block 720**.

For the sake of illustration, suppose that throughout the recording of the MIDI source data 315, a user moves a volume slider to change the volume of a particular program from a particular MIDI instrument 130 a number of times, but only between 25 percent and 75 percent of the slider's extents (e.g., from a coarse volume value of #32 to a coarse volume value of #96). In some cases, the user may desire that a volume fader control is inferred from the data, but that the extents of the fader will only range between the maximum and minimum values found in the recording. In this case, the virtual fader could be generated to graphically range only between 25-percent and 75-percent volume levels (i.e., rather than zero-percent and 100-percent levels, respectively); to graphically range between zero-percent and 100-percent, but to allow interactivity (movement) only between the 25-percent and 75-percent levels); to graphically range between zero-percent and 100-percent with graphical indications of the maximum and minimum extents of the MIDI source data 315 (i.e., at 25-percent and 75-percent levels); or in any other useful way.

At block 724, a determination is made as to whether any bank switching is identified on the same channel and port as the proposed control. For example, the bank switch data may have been identified in block 604 of FIG. 6. As discussed above, if a MIDI instrument control 135 is used on multiple banks, it may be desirable to generate multiple proposed controls to automate those different control functions. However, embodiments may then force each of the multiple virtual sequencer controls 325 corresponding to the same MIDI instrument control 135 to send out bank switch data when used, to maintain correspondence with the appropriate control function. An attribute (e.g., "bank required") may be associated with the proposed control to indicate whether or not bank switch data is needed for accurate automation via the proposed control. The determination made at block 724 is effectively a determination of whether it is desirable to set or clear this attribute (e.g., or indicate that preference in any other way). If it is determined that no bank switch data is needed for the proposed control (e.g., the corresponding MIDI instrument control 135 appears to be used only on a single bank), the "bank required" attribute may be cleared at block 728. Otherwise, the attribute may be set at block 732.

It may be desirable to clear all bank commands from the MIDI source data 315. For example, at this stage, each single-bank MIDI instrument control 135 should correspond to a single proposed virtual sequencer control 325, and each multi-bank MIDI instrument control 135 should correspond to a separate proposed virtual sequencer control 325 for control on each bank. As such, any bank commands would likely cause unnecessary bank switching for virtual sequencer controls 325. Accordingly, at block 736, all bank commands for each proposed control are cleared from the MIDI source data 315 (e.g., from the portion spanning the learn window).

In some embodiments, a check may be made of command data falling outside the learn window to ensure that the learn window did not cut off desired data. Suppose, for example, that the sequence of MIDI commands for a particular MIDI instrument control 135 indicates a change to Bank A after ten seconds and a change to Bank B after twenty seconds. Various options may exist for determining what Bank to associate with the first ten seconds. In one case, the MIDI instrument control 135 could have been set to Bank B initially (prior to being switched to Bank A and subsequently returned to Bank B), such that the entire control functionality can be automated using two virtual sequencer controls 325. In another case, the MIDI instrument control 135 could have been set to Bank C initially (prior to being switched to Bank A and subsequently to Bank B), such that the entire control functionality can be automated using three virtual sequencer controls 325. Similarly, expanding the window in some cases may yield more information about a control's extents or other types of information.

At block 740, a determination is made as to whether more proposed controls need to be analyzed to determine extents or bank requirements. If so, the method **530*a* may iterate through blocks 712-736 for the remaining controls. If not, embodiments of the method 530*a* clear all MIDI control data for the proposed controls from the MIDI source data 315. As discussed above, each virtual sequencer control 325 can be implemented as a sequencer object that is associated with its own sequencer data. Accordingly, the sequence of MIDI commands associated with each proposed control may be extracted from the MIDI source data 315, segregated by proposed virtual sequencer control 325, and stored as a sequence of commands for the proposed virtual sequencer control 325 to which they correspond. In effect, each virtual sequencer control 325 becomes its own mini-sequencer. In fact, embodiments provide each virtual sequencer control 325** with sequencer functionality, such as record and playback functions, editing functions (e.g., cut, copy, paste), and/or other functions.

Returning to FIG. 5, it will be appreciated that the output of block 530 may include a set of proposed virtual sequencer controls 325, each having a set of inferred attributes. The inferred attributes may include, for example, a controller type, controller extents, controller channel and/or port, controller bank required, etc. Embodiments of the method 500 may then determine, for each proposed control, whether an identical control already exists at block 540. For example, the current virtual MIDI instrument stack loaded in the MIDI sequencer 105 may include a fader for controlling volume over a particular Channel and port. If the output of block 530 includes an inferred proposed virtual sequencer control 325 to also control volume over the same channel and port, this would indicate that the control already exists at block 540.

If the same virtual sequencer control 325 does not already exist in the MIDI sequencer 105 (e.g., is not in the currently loaded stack), the proposed control can be created as a virtual sequencer control 325 at block 550. In various embodiments, creating the virtual sequencer control 325 can involve generating any GUI-related data, including laying out the virtual sequencer control 325 in a particular location at a particular size, etc., and setting up the GUI to handle interactions with the virtual sequencer control 325. If the same virtual sequencer control 325 is not found to already exist in the MIDI sequencer 105, embodiments overwrite any existing, conflicting control data with the new control data. For example, any data that is associated with the previously existing virtual sequencer control 325 for that learn window may be overwritten by the data extracted from the MIDI source data 315 for the corresponding proposed control for the same learn window. In some embodiments, rather than automatically overwriting the existing control data, the user may be prompted as to whether the control data should be overwritten. For example, the user may be given the option to merge the existing data with the new data, ignore the new data, etc.

At block 570, a determination is made as to whether additional proposed controls need to be analyzed for overlap with existing virtual sequencer controls 325. If so, the method 500 may iterate through blocks 540-560 for the remaining controls. If not, the method 500 may effectively end by returning to normal system operation at block 580.

Figure 8:
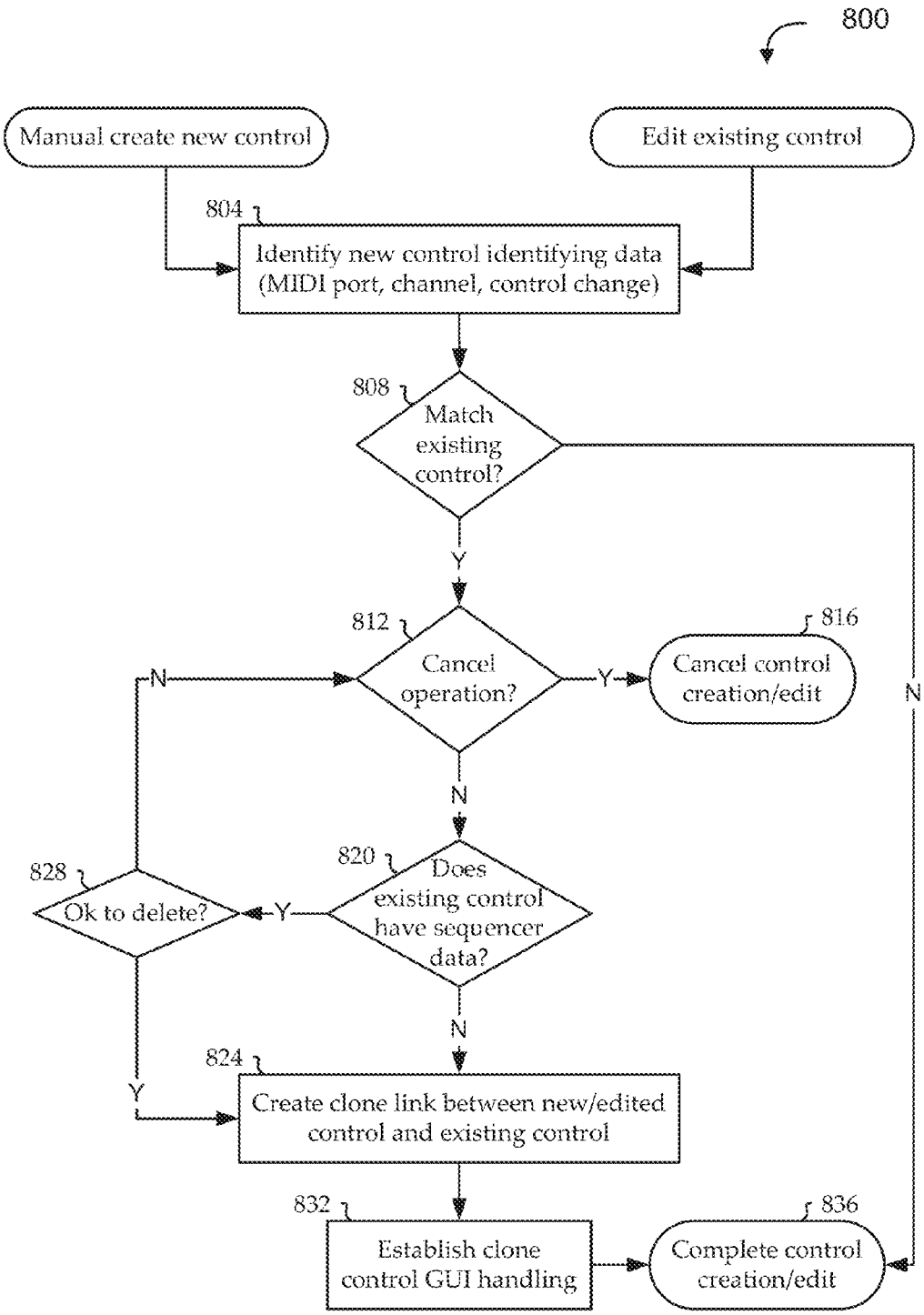
FIG. 8 shows a flow diagram of an illustrative method for creating a clone control, according to various embodiments.

Some additional functionality offered by some embodiments is described with reference to methods of FIGS. 8-10. FIG. 8 shows a flow diagram of an illustrative method 800 for creating a clone control, according to various embodiments. It is not uncommon, particularly in a large studio, to inadvertently have multiple controls configured to control the same thing. For example, a virtual sequencer control 325 may be set to control pan of a particular program, but another virtual sequencer control 325 is already set to control pan for that program (e.g., to send out pan MIDI commands over the same channel and port). In some cases, the user may desire to cancel creation of the matching control. In other cases, the user may desire to keep both controls, but to make sure they operate as clones of each other (i.e., interaction with one is attributed to both).

Suppose a user creates a viral stack having virtual sequencer instruments that correspond to each MIDI instrument 130 in the studio stack (e.g., a set of virtual sequencer controls 325 to match MIDI instrument controls 135 of a MIDI synthesizer, etc.). The user also creates a virtual mixer by assembling a set of virtual faders that independently control volumes of each MIDI instrument 130 in the studio (e.g., each virtual sequencer control 325 automates a volume knob or slider from a different MIDI instrument 130). At least some of the virtual instruments will have a volume control that will be effectively duplicated in the virtual mixer. Accordingly, it may be desirable to ensure that, when a volume fader is moved on the virtual mixer, the corresponding volume fader on the virtual instrument reflects that move (e.g., graphically and in its associated data). Tying together controls in this way is referred to herein as creating a "clone" control.

Embodiments of the method 800 can be invoked in different ways. In one implementation, the method 800 is manually invoked by selecting a menu option or icon to detect clones. In another implementation, the method 800 is automatically invoked whenever a new control is created by manual generation and/or by automatic inferring of the control (e.g., as an option for when the same control is determine to already exist in block 540 of FIG. 5). In yet another implementation, the method 800 is automatically invoked whenever certain control attributes are adjusted. For example, if a virtual sequencer control 325 is modified to control volume on a different channel for a port, the new channel on the port may be found to already have a volume control.

The method 800 begins at block 804 by identifying new control identifying data. For example, the control may be identified by its MIDI port, channel, and control command information (e.g., it is sending pan commands over channel 2 of port 1). At 808, a determination is made as to whether the new control identifying information matches control identifying information of an existing virtual sequencer control 325 loaded in the MIDI sequencer 105. If no matching, existing virtual sequencer control 325 is found, creation or modification of the control can proceed as normal at block 836.

If a matching, existing virtual sequencer control 325 is found, the user may be prompted (e.g., or a default course of action may be predetermined) to decide whether to cancel the operation at block 812. If it is determined to cancel the operation, the creation or modification of the control is canceled at block 816. If it is determined not to cancel the operation, a further determination is made at block 820 as to whether the existing virtual sequencer control 325 has associated sequencer data. If so, a further determination is made at block 828 (e.g., by prompting the user or taking a predetermined course of action) as to whether the existing data can be deleted from the existing virtual sequencer control 325. In some embodiments, if the user does not desire to delete the existing data from the existing virtual sequencer control 325, the user may again be prompted to cancel the operation at block 812. In some alternate embodiments, the user is asked whether any new control data (e.g., data stored in association with the control being modified) should overwrite or be merged with any existing data of the existing virtual sequencer control 325. In other alternate embodiments, when a new virtual sequencer control 325 is being created without any associated sequencer data (e.g., the control is being created manually or certain settings are applied in the MIDI Learn mode), the new control may be associated with the existing control's data by default.

If it is determined that there is no existing control data for the existing virtual sequencer control 325, that any existing data can be deleted, or otherwise that it is appropriate to create the new control as a clone of the existing control, the method 800 may proceed by creating a clone link between the controls at block 824. As discussed above, the clone link may involve ensuring that changes to sequencer data are reflected in the sequencer data of the other. This may be implemented by having both controls pointing to a shared data location, or by effectively synchronizing any data changes to independent data locations. At block 832, the cloning may further involve establishing and/or updating GUI handling functionality for the clones. Various techniques may be included in representing the cloning graphically. One technique may involve forcing the virtual sequencer control 325 to "move" with changes in its data caused by corresponding movements in its clone. Other techniques may involve color coding cloned controls, naming the controls in an indicative way (e.g., as "Control 1" and "Control 1 (clone)"), etc. Any further creation or modification of the control can proceed as normal at block 836.

Figure 9:
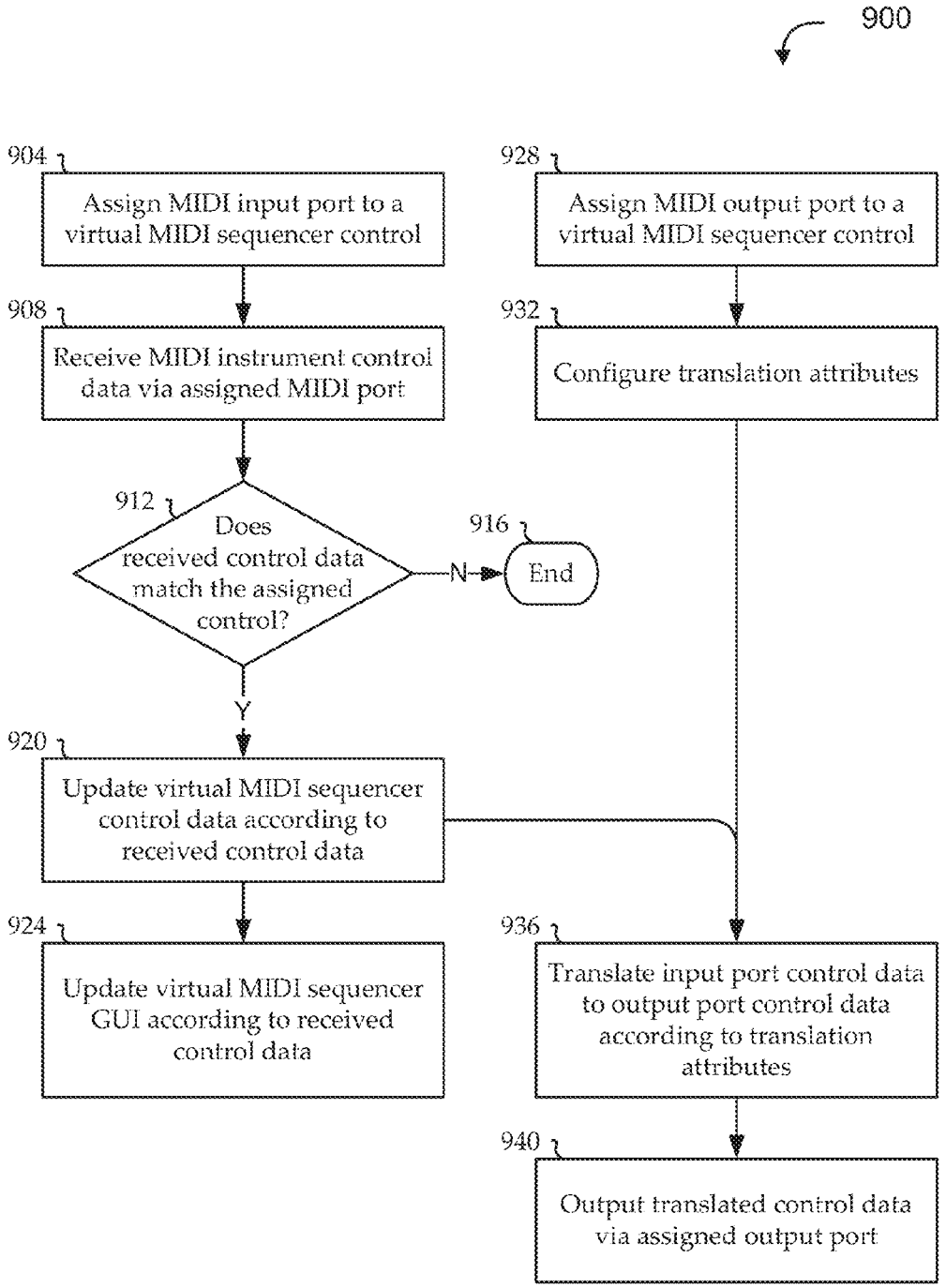
FIG. 9 shows a flow diagram of an illustrative method for slaving a control, according to various embodiments.

FIG. 9 shows a flow diagram of an illustrative method 900 for slaving a control, according to various embodiments. Much of the functionality described above involves using inferred or otherwise created virtual sequencer controls 325 to automate functionality of MIDI instrument controls 135 of MIDI instruments 130. For example, creating the virtual sequencer control 325 as a master to control a MIDI instrument control 135 as a slave can provide automation of that control from the MIDI sequencer 105. In some embodiments, the virtual sequencer control 325 can also (or alternatively) be a slave to the MIDI instrument control 135, such that manipulation of the MIDI instrument control 135 can directly affect the sequencer data and/or graphical representation of the corresponding virtual sequencer control 325.

The method 900 begins at block 904 by assigning a MIDI input port to a virtual sequencer control 325. At block 908, MIDI control data is received via the assigned port. A determination is made at block 812 as to whether the received MIDI control data matches control identifying information of the assigned virtual sequencer control 325. For example, the received data is analyzed to determine whether its channel and control change information match those of the virtual sequencer control 325. If not, the method 800 may end at block 916 (e.g., the command data may be ignored or processed in some other way).

If the received MIDI control data matches control identifying information of the assigned virtual sequencer control 325, the sequencer data of the virtual sequencer control 525 is updated according to the received control data at block 920. In some embodiments, the GUI data for the virtual sequencer control 325 is also updated according to the received control data. For example, if a physical knob is turned on a MIDI instrument 130 in the studio, the data and graphical representation associated with a corresponding virtual sequencer control 325 may change to reflect that physical manipulation of the knob.

In some embodiments, it is desirable to use one MIDI instrument control 135 to control another MIDI instrument control 135. Suppose a first fader on one MIDI instrument 130 controls a high-pass filter cut-off frequency for a white noise generator, and a second fader on a second MIDI instrument 130 controls the volume of a bass program generated by a keyboard synthesizer. A user desires to configure the studio so that as the cut-off frequency of the white noise generator decreases, the volume of the bass program from the synthesizer will increase. Embodiments allow a virtual sequencer control 325 to be configured effectively as a translator, such that control data can be received on one channel and port from the first fader, translated to desired control data for the second fader, and output to the second fader on its proper channel and port.

At block 928, a MIDI output port is assigned to the virtual sequencer control 325. Translation attributes can then be assigned to the virtual sequencer control 325 at block 932. For example, the input and output channels and control commands can be set. Further, embodiments allow the user to set algorithms for use in the translation. For example, it may be desirable to cause the output values to change in a manner that is inverse, proportional, inversely proportional, etc. to that of the input (e.g., if the input values change from #20 to #30, the output values may change from #20 to #10, from #20 to #40, from #20 to #15, etc.). At block 936, the input control data is translated to the output control data according to the translation attributes. The translated control data can then be output over the appropriate output port and channel for control of the desired MIDI instrument control 135.

Figure 10:
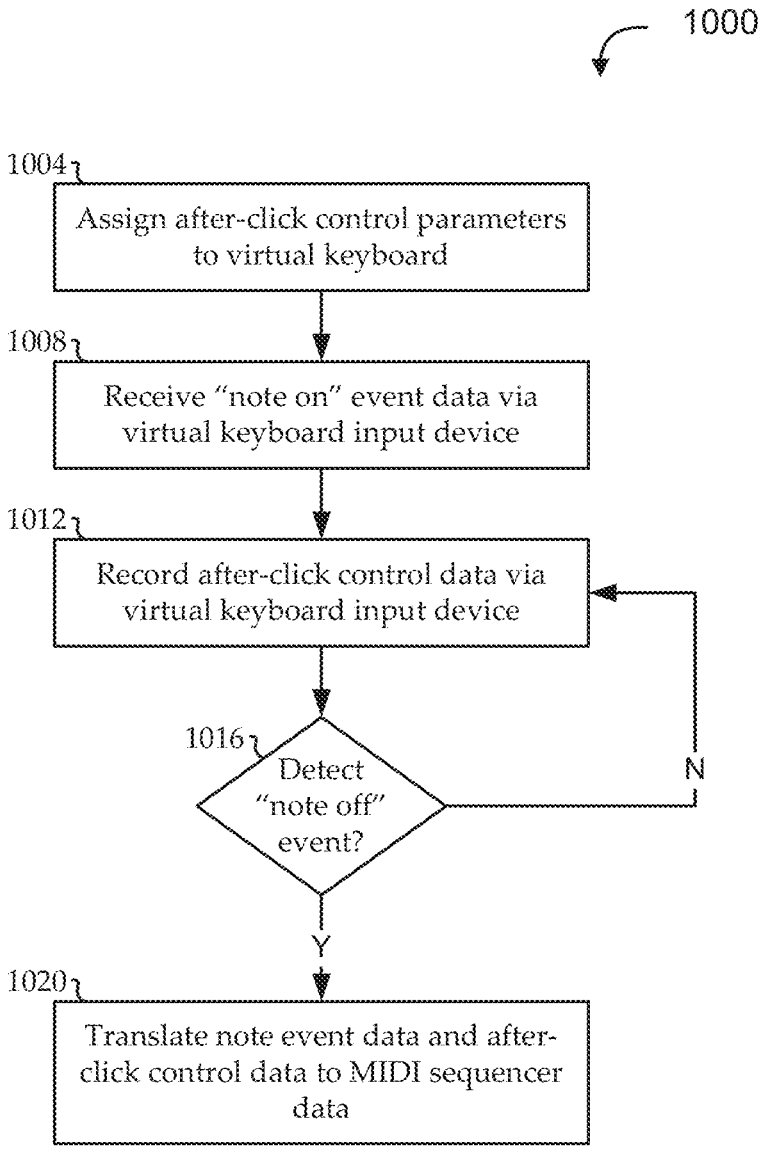
FIG. 10 shows a flow diagram of an illustrative method for creating and handling after-click control functionality, according to various embodiments.

FIG. 10 shows a flow diagram of an illustrative method 1000 for creating and handling after-click control functionality, according to various embodiments. It is common to use a mouse, touch screen, touch pad, stylus, or other standard computer input device to control a "soft" MIDI sequencer 105. It is also common for users to enter at least some MIDI data using virtual synthesizers or the like. However, interactions with virtual synthesizers and the like tend to be limited to using "click on" and "click off" (or similar commands from other standard input devices) to generate "note on" and "note off" MIDI commands, respectively. Notably, some embodiments further support "on-click" functionality. For example, a velocity command may be invoked as an on-click command, where the placement of the click on a virtual "key" of a virtual keyboard indicates a particular desired velocity value.

Embodiments allow a user to generate additional MIDI control commands using virtual synthesizers or the like via standard input devices by providing what is referred to herein as "after-click" control functionality. The method 1000 begins at block 1004 by assigning after-click control parameters to a virtual keyboard or other GUI interface of the MIDI sequencer 105 (e.g., a virtual drum pad, etc.). At block 1008, a "note on" event is detected, for example, as a result of a "click" or similar interaction with a computer interface device. Before the "click" is released (or the corresponding interaction is detected from other types of input devices), after-click data can be recorded.

At block 1012, after-click data is recorded from the input device. For example, the after-click data may indicate that, while continuing to hold down the button of a mouse, the user moved the mouse up and down and/or left and right by certain amounts. Any other types of after-click data can be recorded. For example, a user may click the right button of a two-button mouse while continuing to hold down the left button, a tablet user may tilt the screen while continuing to touch a portion of the screen, a user may slide a finger across a portion of a touch pad while holding another finger on a different portion of the touch pad, a user may hit certain keys on a computer keyboard while holding down the button on the mouse, etc.

A determination is made at block 1016 as to whether a "note off" command is detected (e.g., if the mouse button is released). Until that occurs, the method 1000 may continue to iterate to block 1012, thereby continuing to check for after-click data. At block 1020, the note event data and any after-click control data are translated into sequencer data and stored as appropriate in the MIDI sequencer 105.

It will be appreciated that the after-click functionality can be used in many different ways. In one illustrative case, the user configures a virtual synthesizer to record after-click data to manipulate pitch bend control commands. The user can use a mouse to click on a virtual key of the virtual synthesizer, and, while continuing to hold down the mouse button, the user can move the mouse up and down to invoke pitch bend functionality. In another illustrative case, the user configures a virtual synthesizer to record after-click data to manipulate cross-fading between program patches. The user can use a mouse to click on a virtual key of the virtual synthesizer, and, while continuing to hold down the mouse button, the user can move the mouse left and right to cross-fade between two patches.

Other embodiments implement after-click functions in other ways, in certain embodiments, after-click functions can depend on the placement of a "click" (i.e., these are still referred to herein as "after-click" for the sake of clarity, even though the data may come from the click itself). For example, a virtual synthesizer is used as a drum kit, where each key on the virtual keyboard is assigned to a drum patch. The location at which the user clicks on a key may generate different velocity control command values (e.g., clicking lower on the key generates a lower velocity value). This may, in turn cause the volume and/or sound quality of the audio output to change according to parameters of the associated drum patch.

The various operations of methods described above may be performed by any suitable means capable of performing the corresponding functions. For example, various illustrative logical blocks, modules, and circuits described may be implemented or performed with a general purpose processor, a digital signal processor (DSP), an ASIC, a field programmable gate array signal (FPGA), or other programmable logic device (PLD), discrete gate, or transistor logic, discrete hardware components, or any combination thereof designed to perform the functions described herein. A general purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the present disclosure, may be embodied directly in hardware, in a software module executed by a processor, or in a combination of the two. A software module may reside in any form of tangible storage medium. Some examples of storage media that may be used include random access memory (RAM), read only memory (ROM), flash memory, EPROM memory, EEPROM memory, registers, a hard disk, a removable disk, a CD-ROM and so forth. A storage medium may be coupled to a processor such that the processor can read information from, and write information to, the storage medium. In the alternative, the storage medium may be integral to the processor. A software module may be a single instruction, or many instructions, and may be distributed over several different code segments, among different programs, and across multiple storage media.

Thus, a computer program product may perform operations presented herein. For example, such a computer program product may be a computer readable tangible medium having instructions tangibly stored (and/or encoded) thereon, the instructions being executable by one or more processors to perform the operations described herein. The computer program product may include packaging material. Software or instructions may also be transmitted over a transmission medium. For example, software may be transmitted from a website, server, or other remote source using a transmission medium such as a coaxial cable, fiber optic cable, twisted pair, digital subscriber line (DSL), or wireless technology such as infrared, radio, or microwave.

The methods disclosed herein comprise one or more actions for achieving the described method. The method and/or actions may be interchanged with one another without departing from the scope of the claims. In other words, unless a specific order of actions is specified, the order and/or use of specific actions may be modified without departing from the scope of the claims.

Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

Various changes, substitutions, and alterations to the techniques described herein can be made without departing from the technology of the teachings as defined by the appended claims. Moreover, the scope of the disclosure and claims is not limited to the particular aspects of the process, machine, manufacture, composition of matter, means, methods, and actions described above. Processes, machines, manufacture, compositions of matter, means, methods, or actions, presently existing or later to be developed, that perform substantially the same function or achieve substantially the same result as the corresponding aspects described herein may be utilized. Accordingly, the appended claims include within their scope such processes, machines, manufacture, compositions of matter, means, methods, or actions.

What is claimed is:

1. A method for inferentially generating a virtual sequencer control from a sequence of MIDI commands, the method comprising:

receiving the sequence of MIDI commands generated by a plurality of MIDI instrument controls of at least one MIDI instrument;

identifying a set of control data from the sequence of MIDI commands as sharing an identified MIDI port, an identified MIDI channel, and an identified MIDI control change;

identifying an extended MIDI control command from the sequence of MIDI commands that extends functionality of the identified MIDI control change; and generating a proposed virtual sequencer control within a virtual MIDI sequencer, such that the proposed virtual sequencer control is configured to generate control commands corresponding to the identified MIDI control change and to output the control commands over the identified MIDI port and the identified MIDI channel in accordance with the extended functionality of the extended MIDI control command.

2. The method of claim 1, wherein:

the identified MIDI channel is a first MIDI channel;

identifying the extended MIDI control command from the sequence of MIDI commands that extends functionality of the identified MIDI control change comprises identifying a second MIDI channel associated with the extended MIDI control command; and generating the proposed virtual sequencer control within the virtual MIDI sequencer is in accordance with the extended functionality of the extended MIDI control command only when it is determined, according to a predefined channel mapping, that the extended MIDI control command operates to extend functionality of the identified MIDI control change when the extended MIDI control command is communicated on the second MIDI channel and data corresponding to the identified MIDI control change is communicated on the first MIDI channel.

3. The method of claim 2, wherein the first MIDI channel is different from the second MIDI channel.

4. The method of claim 2, wherein the proposed virtual sequencer control is configured to generate extended control commands corresponding to the extended functionality of the extended MIDI control command and to output the extended control commands over the identified MIDI port and the second MIDI channel.

5. The method of claim 1, wherein the extended MIDI control command is a bank switch command.

6. The method of claim 5, wherein the proposed virtual sequencer control is configured to be associated with a particular bank according to the received bank switch command, and, when generating control commands, to:

determine a present bank associated with the identified MIDI port and the identified MIDI channel; and output a generated bank switch command only when the present bank is different from the particular bank.

7. The method of claim 6, wherein the bank switch command is received over a particular MIDI channel, and the proposed virtual sequencer control is configured to output the generated bank switch command over the particular MIDI channel.

8. The method of claim 5, wherein:

the extended MIDI control command indicates a change from a first bank associated with the identified MIDI control change during a first time window to a second bank associated with the identified MIDI control change during a second time window; and generating the proposed virtual sequencer control within the virtual MIDI sequencer comprises:

generating a first proposed virtual sequencer control corresponding to the identified MIDI control change to output the control commands over the identified MIDI port, the identified MIDI channel, and the first bank in accordance with the extended MIDI control command; and generating a second proposed virtual sequencer control corresponding to the identified MIDI control change to output the control commands over the identified MIDI port, the identified MIDI channel, and the second bank in accordance with the extended MIDI control command.

9. The method of claim 1, wherein the extended MIDI control command is a non-registered parameter number or a registered parameter number command.

10. The method of claim 1, further comprising:

generating an interactive graphical user interface element corresponding to the proposed virtual sequencer control, such that user manipulation of the graphical user interface element causes the proposed virtual sequencer control to generate and output control commands according to the manipulation.

11. A computer-implemented sequencer system configured to communicate with a plurality of MIDI instrument controls of at least one MIDI instrument via a plurality of MIDI channels over at least one MIDI port, the sequencer system comprising:

a plurality of virtual sequencer control modules, each configured to generate and output control commands for automating at least one of the MIDI instrument controls;

a graphical user interface (GUI) module configured to provide manipulation of the control commands associated with each virtual sequencer control via virtual manipulation by a user of an interactive GUI element corresponding to that virtual sequencer control; and an inferential control generator, configured to:

identify a set of control data from a received sequence of MIDI commands as sharing an identified MIDI port, an identified MIDI channel, and an identified MIDI control change, all associated with a particular MIDI instrument control;

identify an extended MIDI control command from the sequence of MIDI commands that extends functionality of the identified MIDI control change; and generate a proposed virtual sequencer control configured to generate control commands corresponding to the identified MIDI control change and to output the control commands over the identified MIDI port and the identified MIDI channel in accordance with the extended functionality of the extended MIDI control command.

12. The sequencer system of claim 11, wherein the inferential control generator is further configured to:

generate a virtual sequencer control module from the proposed virtual sequencer control.

13. The sequencer system of claim 11, wherein the GUI further comprises a learn mode interface configured to allow a user to preselect a learn widow defining a temporal portion of a MIDI source data location from which to parse the sequence of MIDI commands for use in inferential control generation.

14. The sequencer system of claim 11, wherein:

the identified MIDI channel is a first MIDI channel;

the inferential control generator is configured to identify the extended MIDI control command from the sequence of MIDI commands that extends functionality of the identified MIDI control change by identifying a second MIDI channel associated with the extended MIDI control command; and the inferential control generator is configured to generate the proposed virtual sequencer control within the virtual MIDI sequencer in accordance with the extended functionality of the extended MIDI control command only when it is determined, according to a predefined channel mapping, that the extended MIDI control command operates to extend functionality of the identified MIDI control change when the extended MIDI control command is communicated on the second MIDI channel and data corresponding to the identified MIDI control change is communicated on the first MIDI channel.

15. The sequencer system of claim 14, wherein the first MIDI channel is different from the second MIDI channel.

16. The sequencer system of claim 14, wherein the proposed virtual sequencer control is configured to generate extended control commands corresponding to the extended functionality of the extended MIDI control command and to output the extended control commands over the identified MIDI port and the second MIDI channel.

17. The sequencer system of claim 11, wherein the extended MIDI control command is a bank switch command.

18. The sequencer system of claim 17, wherein the proposed virtual sequencer control is configured to be associated with a particular bank according to the received bank switch command, and, when generating control commands, to:

determine a present bank associated with the identified MIDI port and the identified MIDI channel; and output a generated bank switch command only when the present bank is different from the particular bank.

19. The sequencer system of claim 18, wherein the bank switch command is received over a particular MIDI channel, and the proposed virtual sequencer control is configured to output the generated bank switch command over the particular MIDI channel.

20. The sequencer system of claim 17, wherein:

the extended MIDI control command indicates a change from a first bank associated with the identified MIDI control change during a first time window to a second bank associated with the identified MIDI control change during a second time window; and the inferential control generator is configured to generate the proposed virtual sequencer control within the virtual MIDI sequencer by:

generating a first proposed virtual sequencer control corresponding to the identified MIDI control change to output the control commands over the identified MIDI port, the identified MIDI channel, and the first bank in accordance with the extended MIDI control command; and generating a second proposed virtual sequencer control corresponding to the identified MIDI control change to output the control commands over the identified MIDI port, the identified MIDI channel, and the second bank in accordance with the extended MIDI control command.

* * * * *